US008656876B2

(12) United States Patent
Fujiyoshi et al.

(10) Patent No.: US 8,656,876 B2
(45) Date of Patent: Feb. 25, 2014

(54) VALVE TIMING CONTROL APPARATUS

(75) Inventors: Toshiki Fujiyoshi, Okazaki (JP); Masaki Numakura, Toyota (JP); Yuu Yokoyama, Okazaki (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 276 days.

(21) Appl. No.: 13/093,485

(22) Filed: Apr. 25, 2011

(65) Prior Publication Data

US 2011/0259289 A1 Oct. 27, 2011

(30) Foreign Application Priority Data

Apr. 26, 2010 (JP) ..... 2010-101170

(51) Int. Cl.
*F01L 1/34* (2006.01)

(52) U.S. Cl.
USPC ..... 123/90.17; 123/90.15

(58) Field of Classification Search
USPC ..... 123/90.17, 90.15, 90.12; 464/160; 74/568 R
See application file for complete search history.

(56) References Cited

U.S. PATENT DOCUMENTS

| | | | | |
|---|---|---|---|---|
| 8,166,937 | B2 * | 5/2012 | Yamaguchi et al. | 123/90.17 |
| 2002/0121253 | A1 | 9/2002 | Hase | |
| 2002/0139332 | A1 | 10/2002 | Takenaka | |
| 2002/0139333 | A1 * | 10/2002 | Kusano et al. | 123/90.17 |
| 2009/0260591 | A1 | 10/2009 | Yamaguchi et al. | |
| 2010/0199938 | A1 | 8/2010 | Hamaoka et al. | |

FOREIGN PATENT DOCUMENTS

| | | | |
|---|---|---|---|
| JP | P2001-055934 | A | 2/2001 |
| JP | P2002-295276 | A | 10/2002 |
| JP | P2002-357105 | A | 12/2002 |
| JP | 2003-20916 | | 1/2003 |
| JP | P2010-255472 | A | 11/2010 |
| JP | P2010-270746 | A | 12/2010 |
| WO | WO 2010/029740 | | 3/2010 |

OTHER PUBLICATIONS

WIPO Document 2010/029740 English Language Machine Translation.*

Office Action (1 page) dated May 8, 2012 issued in corresponding Japanese Application No. 2010-101170 and English translation (2 pages).

U.S. Appl. No. 13/063,628, filed Mar. 11, 2011, in the name of Fujiyoshi et al., corresponds to JP Application No. 2009-193566.

* cited by examiner

*Primary Examiner* — Kenneth Bomberg
*Assistant Examiner* — Wesley Harris
(74) *Attorney, Agent, or Firm* — Nixon & Vanderhye P.C.

(57) ABSTRACT

A primary resilient member urges a primary limiting member into a recess in an inserting direction in a state where a rotational phase is a limited phase in a limited phase range. A relative slide gap is radially provided between the primary limiting member and a secondary limiting member at a location adjacent to a working chamber. First and second primary slide gaps are radially provided between the primary limiting member and radially opposed wall surface sections of the receiving hole. A secondary slide gap is radially provided between the secondary limiting member and a radially opposed wall surface section of the receiving hole. The relative slide gap is larger than the first and second primary slide gaps and the secondary slide gap.

8 Claims, 16 Drawing Sheets

VALVE TIMING CONTROL APPARATUS

CROSS REFERENCE TO RELATED APPLICATION

This application is based on and incorporates herein by reference Japanese Patent Application No. 2010-101170 filed on Apr. 26, 2010.

BACKGROUND OF THE INVENTION

1. Field of the Invention:

The present invention relates to a valve timing control apparatus, which controls valve timing of a valve that is opened or closed by a camshaft through transmission of a torque from a crankshaft of an internal combustion engine.

2. Description of Related Art:

A previously known valve timing control apparatus includes a housing, which is rotated together with a crankshaft, and a vane rotor, which is rotated together with the camshaft. This valve timing control apparatus controls the valve timing through use of hydraulic fluid, which is supplied from a supply source (e.g., a pump) upon rotation of the engine. For instance, the valve timing is controlled by changing a rotational phase of the vane rotor toward an advancing side or a retarding side relative to the housing by guiding the hydraulic fluid, which is supplied from the supply source, into an advancing chamber or a retarding chamber, which are partitioned with a vane of the vane rotor in the housing.

Japanese Unexamined Patent Publication No. 2002-357105A (corresponding to US2002/0139332A1) teaches such a valve timing control apparatus. In this valve timing control apparatus, a limiting member, which is received in the vane rotor, is moved into a recess formed in an inner surface of the housing before the time of stopping the engine. Thereby, at the time of executing the next engine start, the rotational phase is limited to a limited phase, which is between the most advanced phase and the most retarded phase, to ensure the required startability of the engine. In the case of the valve timing control apparatus recited in Japanese Unexamined Patent Publication No. 2002-357105A (corresponding to US2002/0139332A1), when the engine is instantaneously stopped due to an abnormality, the engine may be restarted in a state where the limiting member is not received in the recess. Thus, in such a case where the limiting member is not received in the recess at the time of engine stop, it is required to move the limiting member into the recess within the engine start period. However, when the working fluid remains in the working chamber before the engine start, the limiting member, which receives the pressure of the hydraulic fluid supplied into the working chamber in the direction away from the recess, needs to be moved in the inserting direction toward the recess while pushing the remaining hydraulic fluid out of the working chamber during the engine start period. Therefore, under the low temperature environment, in which the viscosity of the working fluid is increased, the movement of the limiting member into the recess cannot be made in time, so that the startability of the engine is disadvantageously deteriorated.

In view of the above disadvantage, the inventor of the present invention has proposed to limit the rotational phase by using two types of limiting members and two types of resilient members in Japanese Patent Application No. 2009-193566 (corresponding to WO/2010/029740A1). Specifically, in the valve timing control apparatus recited in Japanese Patent Application No. 2009-193566 (corresponding to WO/2010/029740A1), when the engine is stopped before the time of moving a primary limiting member (i.e., one of the two limiting members) into the recess formed in the inner surface of the housing, the pressure, which is introduced into the working chamber, is reduced. Therefore, the secondary limiting member (i.e., the other one of the two limiting members) is urged by the corresponding secondary resilient member and is thereby moved into the recess. The primary limiting member, which is engageable with an engaging portion of the secondary limiting member, is urged against the engaging portion of the secondary limiting member by the corresponding primary resilient member in the inserting direction thereof together with the secondary limiting member. In this way, at the rotational phase, which is different from the limited phase, the primary limiting member contacts the inner surface of the housing in the removed state of the primary limiting member where the primary limiting member is removed out of the recess.

Even when the primary limiting member is engaged with the inner surface of the housing through this engagement, the secondary limiting member, which is urged by the secondary urging member, pushes the remaining working fluid, which remains in the working chamber, and the engaging portion of the secondary limiting member is spaced from the primary limiting member. Therefore, in the next engine start period, when the rotational phase is changed to the limited phase to move the primary limiting member into the recess through use of an oscillating torque, which is generated by cranking of the engine, the primary limiting member can be quickly moved in the inserting direction. As a result, even in the low temperature environment, the primary limiting member can be quickly moved into the recess to limit the rotational phase at the limited phase, so that the startability of the engine can be ensured.

In the case of the valve timing control apparatus, which is recited in Japanese Patent Application No. 2009-193566 (corresponding to WO/2010/029740A1), the primary limiting member and the secondary limiting member are slidably received in the receiving hole of the housing, and the primary limiting member is slidably received in the secondary limiting member, which is configured into the tubular form. In the case of the above construction, when the slide gap between each of the primary and secondary limiting members and the receiving hole and the slide gap between the primary limiting member and the secondary limiting member are both increased, the correct orientation of each of the primary and secondary limiting members cannot be maintained, so that the primary limiting member may possibly be tilted or may experience an inserting malfunction (i.e., the primary limiting member being not appropriately inserted into the recess due to an interference with the tilted secondary limiting member). In contrast, when the slide gap between each of the primary and secondary limiting members and the receiving hole and the slide gap between the primary limiting member and the secondary limiting member are both decreased, the primary limiting member and the secondary limiting member may possibly interfere with each other due to the presence of the manufacturing tolerance. Also, a shearing resistance is applied to each of the primary and secondary limiting members due to the presence of the working fluid, which enters the slide gap that is adjacent to the working chamber, so that the movement of the primary and secondary limiting members may possibly be interfered. Particularly, at the time of moving the primary limiting member, which is engaged with the inner surface of the housing, into the recess to execute the engine start, when the inserting speed (moving speed) of the primary limiting member in the inserting direction is decreased due to the interference and/or the presence of the shearing resistance, the primary limiting member may possibly not be entered into the recess in time within the engine start period.

SUMMARY OF THE INVENTION

The present invention is made in view of the above disadvantages. According to the present invention, there is provided a valve timing control apparatus for an internal combustion engine. The valve timing control apparatus is supplied with hydraulic fluid from a supply source upon rotation of the internal combustion engine to control valve timing of a valve, which is opened or closed by a camshaft that is, in turn, driven by a torque transmitted from a crankshaft of the internal combustion engine. The valve timing control apparatus includes a housing, a vane rotor, a primary limiting member, a primary resilient member, a secondary limiting member and a secondary resilient member. The housing is adapted to be driven together with the crankshaft and includes a recess, which is recessed in an inner surface of the housing. The vane rotor includes a vane and a receiving hole. The vane partitions between an advancing chamber and a retarding chamber in an inside of the housing. The receiving hole forms a working chamber therein. The vane rotor is adapted to be rotated together with the camshaft and is rotatable relative to the housing to change a rotational phase toward a corresponding one of an advancing side and a retarding side when the hydraulic fluid is supplied into a corresponding one the advancing chamber and the retarding chamber. The primary limiting member is received in the receiving hole and is slidable in both of an inserting direction toward the surface of the housing and a removing direction away from the surface of the housing. The primary limiting member limits the rotational phase to a limited phase, which is between a most advanced phase and a most retarded phase, when the primary limiting member is inserted into the recess in the inserting direction. The primary limiting member enables release of the rotational phase from the limited phase when the primary limiting member is removed from the recess in the removing direction. The primary resilient member urges the primary limiting member in the inserting direction. The primary resilient member urges the primary limiting member into the recess in the inserting direction in a state where the rotational phase is the limited phase. The primary resilient member urges the primary limiting member against a corresponding portion of the inner surface of the housing, which is other than the recess, in the inserting direction in a state where the rotational phase is other than the limited phase. The secondary limiting member is received in the receiving hole and is slidable in both of the inserting direction and the removing direction. The secondary limiting member is configured into a tubular body, into which the primary limiting member is slidably received in a manner that enables relative slide movement between the primary limiting member and the secondary limiting member. The secondary limiting member includes an engaging surface, which is disengageable from the primary limiting member in the inserting direction and is engageable with the primary limiting member in the removing direction. The secondary limiting member receives a pressure of the hydraulic fluid, which is provided in the working chamber, in the removing direction. The secondary resilient member urges the secondary limiting member in the inserting direction. A relative slide gap is radially provided between the primary limiting member and the secondary limiting member at a location adjacent to the working chamber to enable relative slide movement between the primary limiting member and the secondary limiting member. At least one primary slide gap is radially provided between the primary limiting member and at least one radially opposed wall surface section of the receiving hole, which is radially opposed to the primary limiting member, to enable slide movement of the primary limiting member relative to the at least one radially opposed wall surface section of the receiving hole, which is radially opposed to the primary limiting member. A secondary slide gap is radially provided between the secondary limiting member and a radially opposed wall surface section of the receiving hole, which is radially opposed to the secondary limiting member, to enable slide movement of the secondary limiting member relative to the radially opposed wall surface section of the receiving hole, which is radially opposed to the secondary limiting member. The relative slide gap is larger than the at least one primary slide gap and the secondary slide gap.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
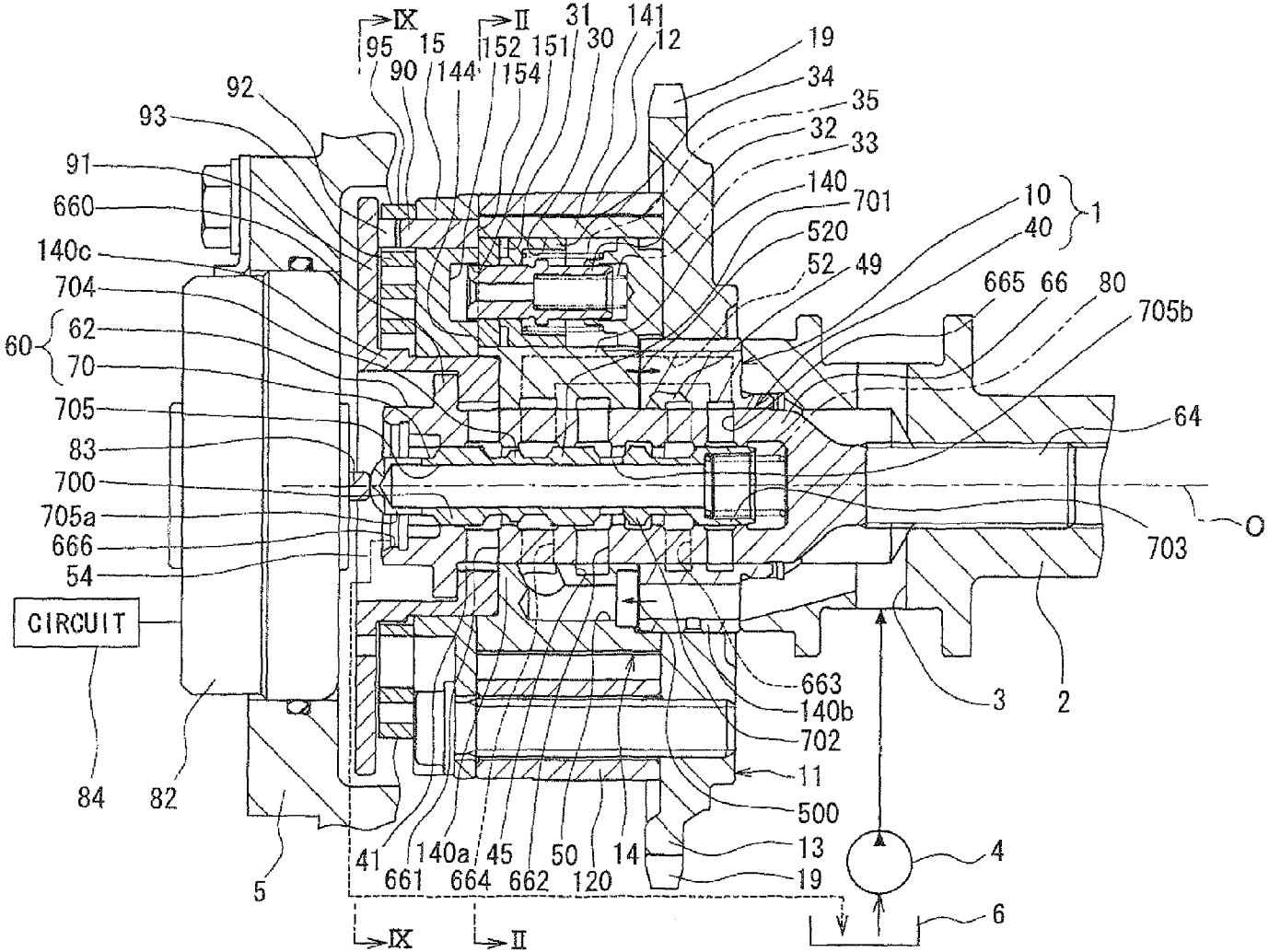
FIG. 1 is a cross sectional view taken along line I-I in FIG. 2, showing a structure of a valve timing control apparatus according to an embodiment of the present invention.

An embodiment of the present invention will be described with reference to the accompanying drawings. FIG. 1 shows a valve timing control apparatus 1 of the present embodiment installed to an internal combustion engine of a vehicle (more specifically, an automobile). The valve timing control apparatus 1 controls valve timing of an intake valve (serving as a drive-subject valve or simply referred to as a valve) through use of hydraulic oil (serving as hydraulic fluid). The valve timing control apparatus 1 includes a drive device 10 and a control device 40. The drive device 10 is placed in a transmission system, which transmits an engine torque from a crankshaft (not shown) to a camshaft 2. The drive device 10 is driven by the hydraulic oil. The control device 40 controls the supply of the hydraulic oil to the drive device 10.

Figure 2:
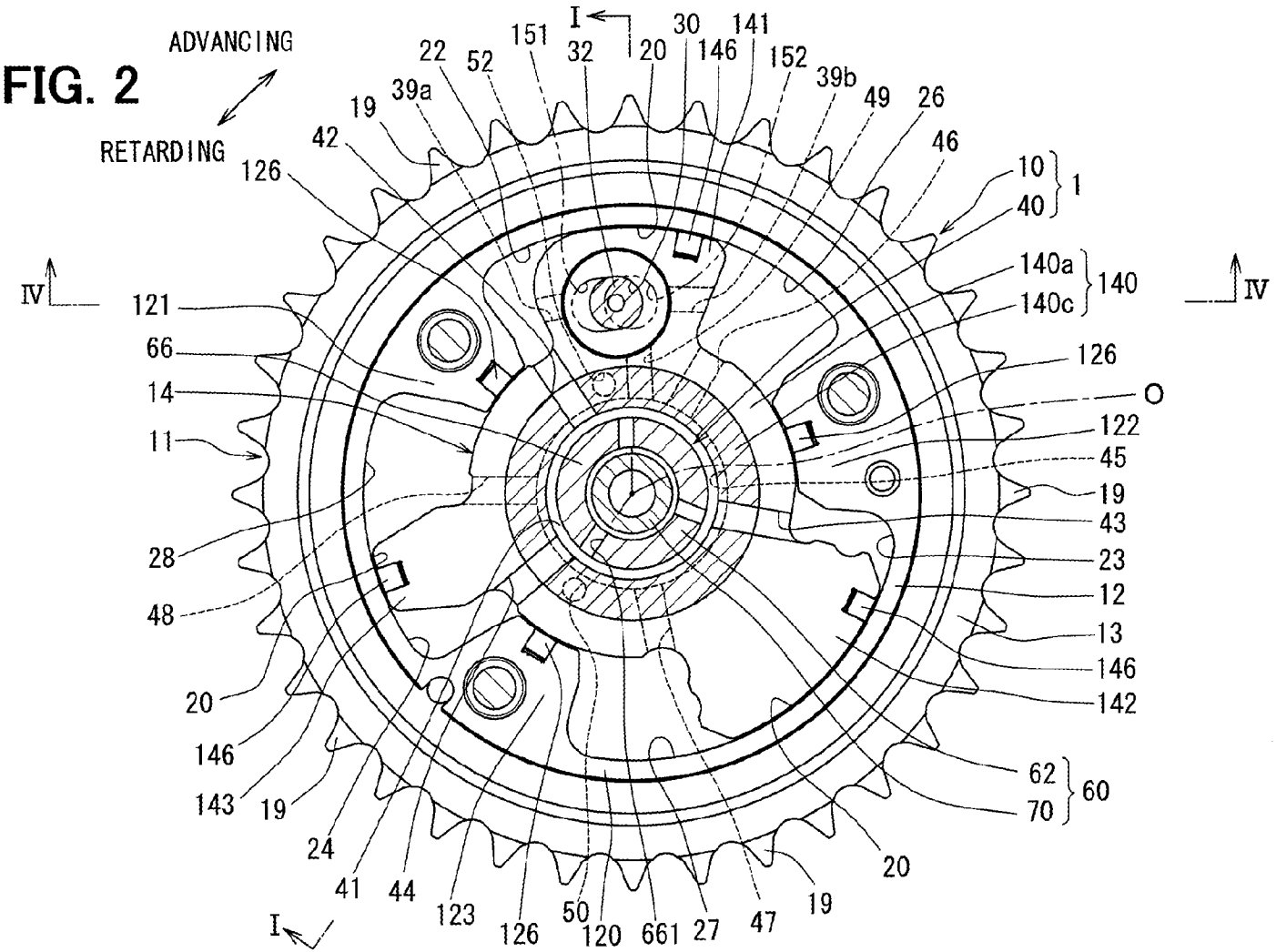
FIG. 2 is a cross sectional view taken along line II-II in FIG. 1.

In the drive device 10 shown in FIGS. 1 and 2, a housing 11 includes a shoe housing 12, a sprocket 13 and a front plate 15.

The shoe housing 12 is made of metal and includes a housing main body 120, which is configured into a cylindrical tubular form, and a plurality of shoes 121-123, which serve as partitions. The shoes 121-123 are arranged one after another at predetermined intervals along the housing main body 120 in a rotational direction and radially inwardly project from the housing main body 120. A seal member 126 is installed in a projecting end part of each of the shoes 121-123 and slidably contacts an outer peripheral part of a rotatable shaft 140 of a vane rotor 14 to seal between the projecting end part of the shoe 121-123 and the outer peripheral part of the rotatable shaft 140. A compartment 20 is circumferentially defined between each circumferentially adjacent two of the shoes 121-123, which are adjacent to each other in the rotational direction.

Each of the sprocket 13 and the front plate 15 is made of metal and is configured into an annular plate form. The sprocket 13 and the front plate 15 are coaxially fixed to two opposed axial end parts, respectively, of the shoe housing 12. The sprocket 13 includes a plurality of teeth 19, which are arranged one after another at equal intervals in the circumferential direction and project radially outward. The sprocket 13 is connected to the crankshaft through a timing chain (not shown), which is wound around the teeth 19 of the sprocket 13. With the above construction, at the time of driving the engine, the engine torque is transmitted from the crankshaft to the sprocket 13, and thereby the housing 11 is rotated about a central axis O in a clockwise direction in FIG. 2 synchronously with the crankshaft.

The vane rotor 14 is made of metal and is coaxially received in the housing 11. Two opposed axial end parts of the vane rotor 14 slidably contact the sprocket 13 and the front plate 15, respectively. The vane rotor 14 includes a rotatable shaft 140, which is configured into a cylindrical tubular form, and a plurality of vanes 141-143.

The rotatable shaft 140 is coaxially fixed to the camshaft 2. Thereby, the vane rotor 14 rotates about the central axis O in the clockwise direction in FIG. 2 synchronously with the camshaft 2. Furthermore, the vane rotor 14 can rotate relative to the shoe housing 12. The rotatable shaft 140 includes a shaft main body 140*a*. A boss 140*b* and a bush 140*c* are coaxially fixed to two opposed axial end parts, respectively, of the shaft main body 140*a*. The boss 140*b* axially extends through the sprocket 13 and is fixed to the camshaft 2, which is located at an outside of the housing 11. The bush 140*c* axially extends through the front plate 15 and opens at the outside of the housing 11. The vanes 141-143 radially outwardly project at three locations, respectively, of the shaft main body 140*a* of the rotatable shaft 140, which are placed one after another at predetermined intervals, so that the vanes 141-143 are received in the compartments 20, respectively. A seal member 146 is installed to a projecting end part of each of the vanes 141-143 and slidably contacts an inner peripheral part of the housing main body 120 to seal between the projecting end part of the vane 141-143 and the inner peripheral part of the housing main body 120.

Each of the vanes 141-143 partitions the corresponding one of the compartments 20 into an advancing chamber 22-24 and a retarding chamber 26-28 in the housing 11. Specifically, the advancing chamber 22 is formed between the shoe 121 and the vane 141. The advancing chamber 23 is formed between the shoe 122 and the vane 142. Furthermore, the advancing chamber 24 is formed between the shoe 123 and the vane 143. In addition, the retarding chamber 26 is formed between the shoe 122 and the vane 141. The retarding chamber 27 is formed between the shoe 123 and the vane 142. Furthermore, the retarding chamber 28 is formed between the shoe 121 and the vane 143.

Thus, in the drive device 10, when the hydraulic oil is supplied into the advancing chambers 22-24 while draining the hydraulic oil from the retarding chambers 26-28, the rotational phase of the vane rotor 14 relative to the housing 11 is changed to the advancing side, and thereby the valve timing is advanced. In contrast, when the hydraulic oil is supplied into the retarding chambers 26-28 while draining the hydraulic oil from the advancing chambers 22-24, the rotational phase of the vane rotor 14 relative to the housing 11 is changed to the retarding side, and thereby the valve timing is retarded.

In the present embodiment, with respect to the rotational phase, which determines the valve timing, a limited phase range is set to ensure the required startability of the engine at the time of starting the engine. That is, the rotational phase is restricted, i.e., is limited within the limited phase range (i.e., limited to a corresponding limited phase in the limited phase range) at the time of starting the engine. This limited phase range is set to be from a middle phase, which is defined between the most retarded phase and the most advanced phase, to the most advanced phase. Furthermore, in the present embodiment, a predetermined lock phase is set within the limited phase range to ensure the best startability of the engine regardless of the surrounding environmental temperature. With the above setting, in the engine start period, during which the engine is cranked, it is possible to limit an excessive reduction in a quantity of the air drawn into each corresponding cylinder caused by a delay in the valve closing timing of the intake valve. Thereby, the engine can be appropriately started.

In the control device 40 shown in FIGS. 1 and 2, a primary advancing passage 41 is formed along the inner peripheral part of the bush 140*c* of the rotatable shaft 140. Three branched advancing passages 42, 43, 44 extend through the rotatable shaft 140 and are communicated with the advancing chambers 22-24, respectively, on one side thereof and are also communicated with the primary advancing passage 41 on the other side thereof. A primary retarding passage 45 is formed as an annular groove, which opens in the inner peripheral part of the rotatable shaft 140. Three branched retarding passages 46, 47, 48 extend through the rotatable shaft 140 and are communicated with the retarding chambers 26-28, respectively, on one side thereof and are also communicated with the primary retarding passage 45 on the other side thereof. A lock passage 49 extends through the rotatable shaft 140 and is communicated with a working chamber 31 described later.

The primary supply passage 50 extends through the rotatable shaft 140 and is communicated with a pump (serving as a supply source) 4 through a transfer passage 3. The pump 4 is a mechanical pump, which is driven by the crankshaft upon the rotation of the engine. During the rotation of the engine, the pump 4 continuously pumps the hydraulic oil drawn from an oil pan 6. The transfer passage 3 is always communicated with a discharge port of the pump 4 regardless the rotation of the camshaft 2, so that the transfer passage 3 continuously transfers the hydraulic oil, which is discharged from the pump 4, to the primary supply passage 50 during the rotation of the engine.

Figure 4:
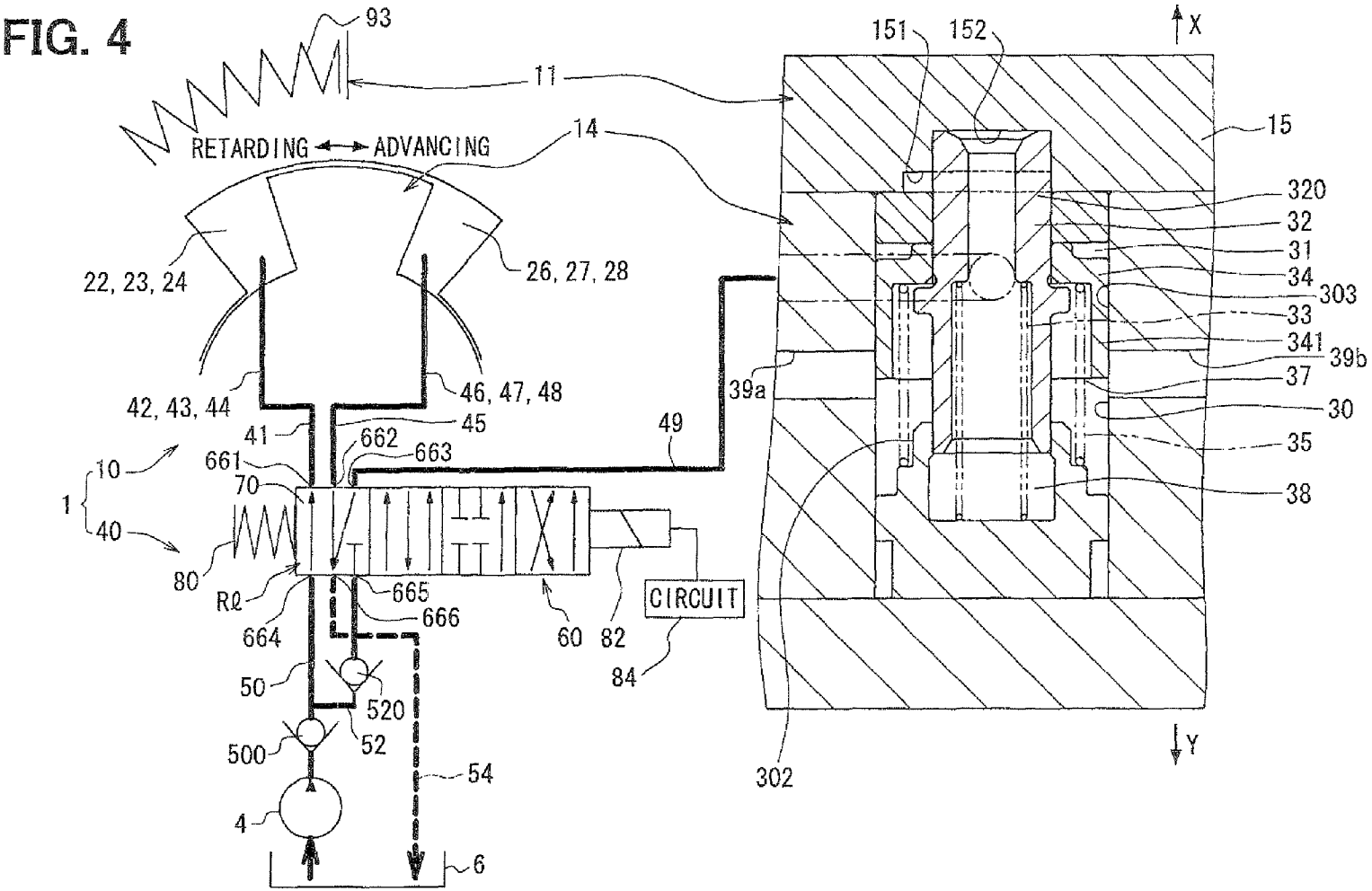
FIG. 4 is a cross-sectional schematic view showing an operational state of the valve timing control apparatus shown in FIG. 1 and indicating a cross section taken along line IV-IV in FIG. 2.

As shown in FIGS. 1 and 4, a secondary supply passage 52 is branched from an intermediate part of the primary supply passage 50 and thereby receives the hydraulic oil from the pump 4 through the primary supply passage 50. A check valve 500, which is formed as a reed valve, is provided in the primary supply passage 50 at a location, which is on the pump 4 side of the branching point where the secondary supply passage 52 is branched from the primary supply passage 50. Also, a check valve 520, which is formed as a reed valve, is provided in the middle of the secondary supply passage 52. The check valve 500 of the primary supply passage 50 limits a backflow of the hydraulic oil toward the pump 4, and the check valve 520 of the secondary supply passage 52 limits a backflow of the hydraulic oil toward the primary supply passage 50.

A drain passage 54 is formed by an opening of the bush 140*c* of the rotatable shaft 140, which opens in an interior of a chain cover 5 of the engine at the outside of the housing 11. The drain passage 54 drains the hydraulic oil from the drive device 10 to the oil pan 6 of the pump 4.

With reference to FIGS. 1 and 2, a control valve 60 is configured as a spool valve, which receives a spool 70 as a valve member in a valve body 62. The control valve 60 is coaxially received in the rotatable shaft 140 of the vane rotor 14 and is rotatable integrally with the rotatable shaft 140 of the vane rotor 14.

The valve body 62 is made of metal and includes a fixing portion 64 and a sleeve portion 66, which are arranged one after another in the axial direction. A male thread is threaded along an outer peripheral surface of the fixing portion 64. The sleeve portion 66 is configured into a cup-shaped body. The fixing portion 64 is threadably engaged with the camshaft 2, so that the components 140*a*, 140*b*, 140*c* of the rotatable shaft 140 are securely held between the camshaft 2 and a flange 660 formed in an outer peripheral wall of the sleeve portion 66. The sleeve portion 66 axially extends along the components 140*a*, 140*b*, 140*c* of the rotatable shaft 140 and opens in the interior of the bush 140*c* at the axial end part of the rotatable shaft 140, which is opposite from the fixing portion 64.

There is provided a plurality of ports 661-665, which are arranged one after another at predetermined intervals in the axial direction along the peripheral wall of the sleeve portion 66 and radially penetrate through the peripheral wall of the sleeve portion 66. Among these ports 661-665, the advancing port 661 is most distant from the fixing portion 64 and is communicated with the primary advancing passage 41. As shown in FIG. 1, the retarding port 662, which is located on the fixing portion 64 side of the advancing port 661, is communicated with the primary retarding passage 45. The lock port 663, which is located on the fixing portion 64 side of the retarding port 662, is communicated with the lock passage 49. A primary supply port 664, which is located between the advancing port 661 and the retarding port 662, is communicated with the primary supply passage 50. A secondary supply port 665, which is located on the fixing portion 64 side of the lock port 663, is communicated with the secondary supply passage 52. Furthermore, an opening of the sleeve portion 66, which opens in the interior of the bush 140*c*, forms a drain port 666 that is communicated with the drain passage 54.

The spool 70, which is made of metal, is configured into a cup-shaped body and is coaxially placed in the sleeve portion 66 such that an opening of the spool 70 is directed toward the fixing portion 64. The spool 70 includes a plurality of annular lands 700-703, which are placed one after another at predetermined intervals in the axial direction and are axially slidable along an inner peripheral part of the sleeve portion 66. The spool 70 further includes a throttling portion 704, which throttles the flow rate of the hydraulic oil between the advancing port 661 and the primary supply port 664.

A communication hole 705, which extends in the axial direction, is formed in the inside of the spool 70. The communication hole 705 is communicated with the drain port 666 through an opening 705*a* of the communication hole 705, which is formed in a drain port 666 side axial end part of the spool 70. Furthermore, the communication hole 705 is communicatable with the corresponding one of the retarding port 662 and the lock port 663 depending on the moving position of the spool 70 through an opening 705*b*, which is formed between the land 701 and the land 702.

Figure 3:
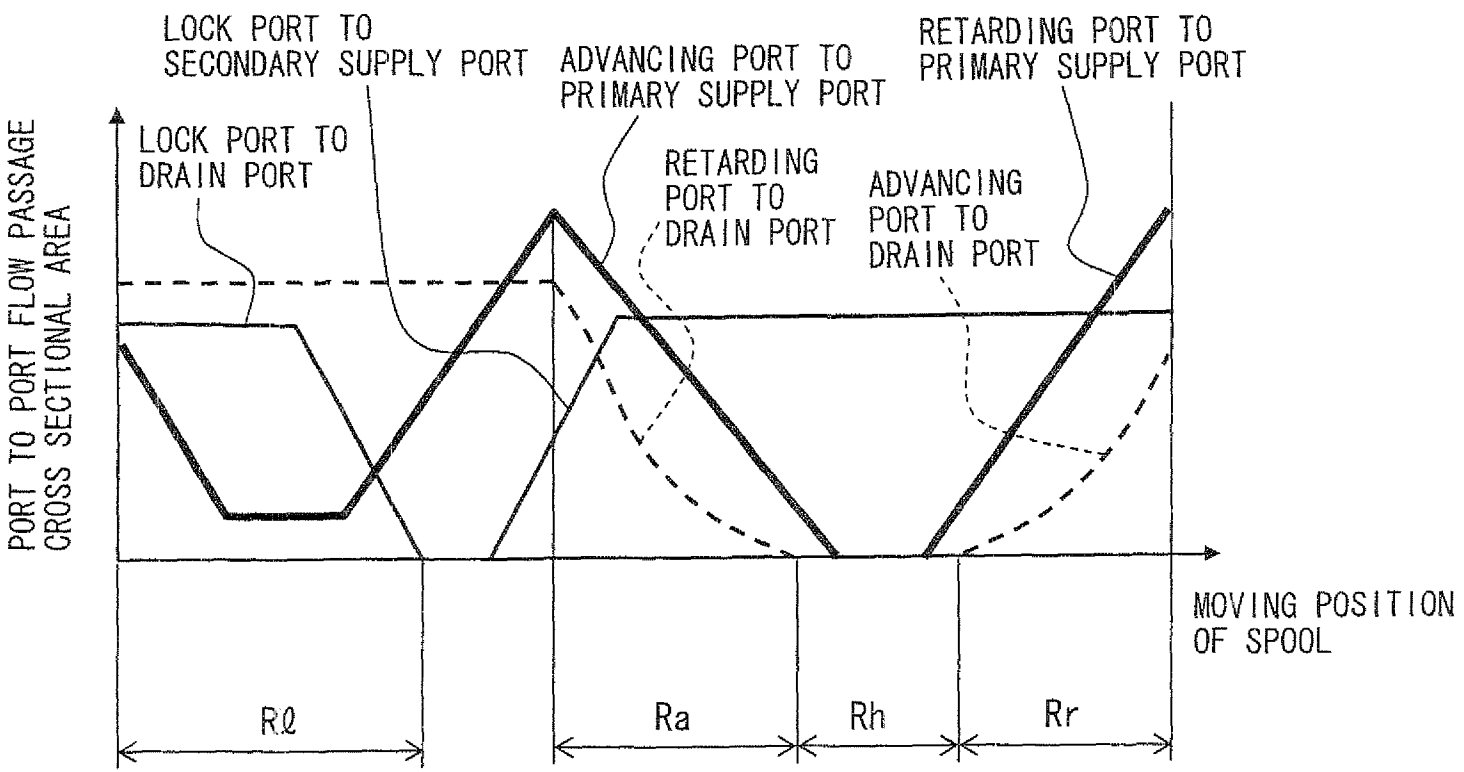
FIG. 3 is a schematic diagram for describing an operation of a control valve shown in FIG. 1.

In this control valve 60, when the spool 70 is moved to a lock range RI of FIGS. 3 and 4, the advancing port 661 is communicated with the primary supply port 664. In this way, the hydraulic oil, which is supplied from the pump 4 to the primary supply passage 50, is guided into the advancing chambers 22-24 through the ports 661, 664 and the passages 41, 42, 43, 44. At this time, the quantity of the hydraulic oil, which is supplied to the advancing chambers 22-24, is reduced by the presence of the throttling portion 704. When the spool 70 is moved to the lock range RI, the retarding port 662 and the lock port 663 are communicated with the drain port 666 through the communication hole 705. In this way, the hydraulic oil is drained from the retarding chambers 26-28 and the working chamber 31 into the oil pan 6, which is located on the downstream side of the drain passage 54, through the passages 46, 47, 48, 45, 49 and the ports 662, 663, 666.

Figure 5:
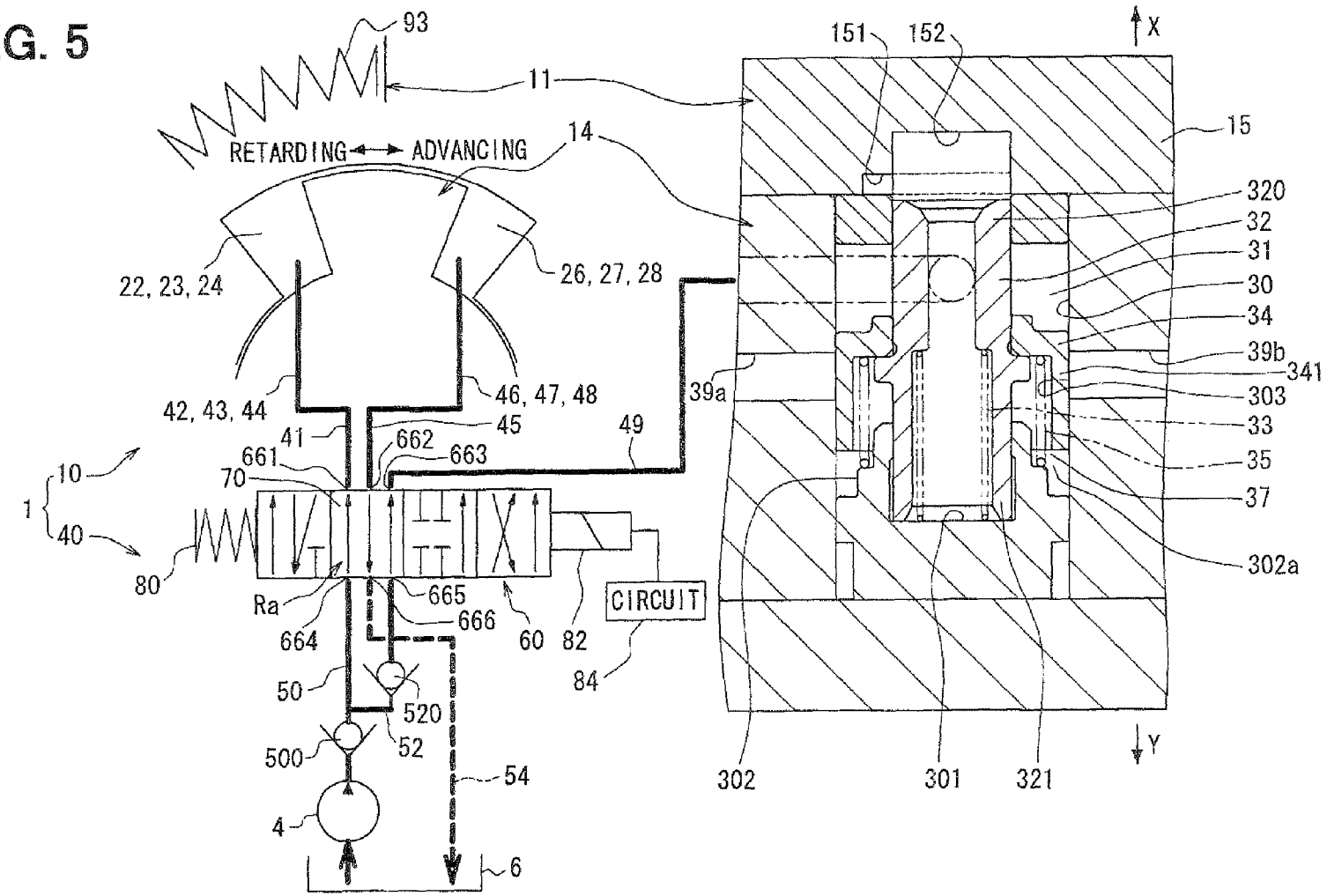
FIG. 5 is a cross-sectional schematic view showing another operational state of the valve timing control apparatus, which is different from that of FIG. 4.

When the spool 70 is moved to an advancing range Ra, which is shown in FIGS. 3 and 5 and is located on a fixing portion 64 side of the lock range RI, the advancing port 661 is communicated with the primary supply port 664. In this way, the hydraulic oil, which is supplied from the pump 4 to the primary supply passage 50, is guided into the advancing chambers 22-24 through the ports 664, 661 and the passages 41-44. When the spool 70 is moved to the advancing range Ra, the retarding port 662 is communicated with the drain port 666 through the communication hole 705. In this way, the hydraulic oil is drained from the retarding chambers 26-28 into the oil pan 6, which is located on the downstream side of the drain passage 54, through the passages 46, 47, 48, 45 and the ports 662, 666. In addition, when the spool 70 is moved to the advancing range Ra, the lock port 663 is communicated with the secondary supply port 665. In this way, the hydraulic oil, which is supplied from the pump 4 to the passages 50, 52, is guided into the working chamber 31 thorough the ports 665, 663 and the lock passage 49.

Figure 6:
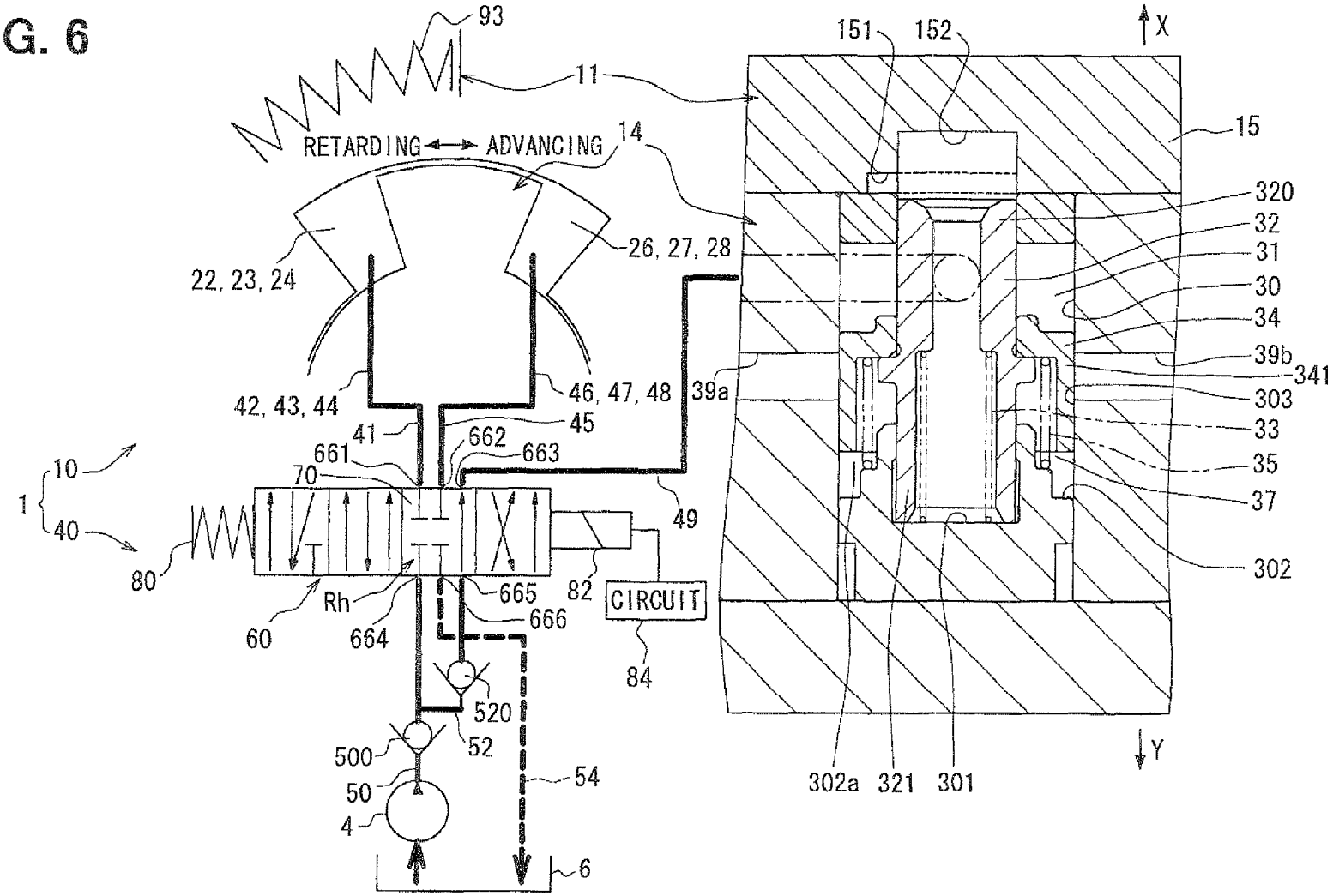
FIG. 6 is a schematic cross sectional view, showing another operational state of the valve timing control apparatus, which is different from those of FIGS. 4 and 5.

Furthermore, when the spool 70 is moved to a holding range Rh, which is shown in FIGS. 3 and 6 and is located on the fixing portion 64 side of the advancing range Ra, the advancing port 661 and the retarding port 662 are disconnected from all of the other ports. In this way, the hydraulic oil does not flow into or out of the advancing chambers 22-24 and the retarding chambers 26-28. When the spool 70 is moved to the holding range Rh, the lock port 663 is communicated with the secondary supply port 665. In this way, the hydraulic oil, which is supplied from the pump 4 to the passages 50, 52, is guided into the working chamber 31 thorough the ports 665, 663 and the lock passage 49.

Figure 7:
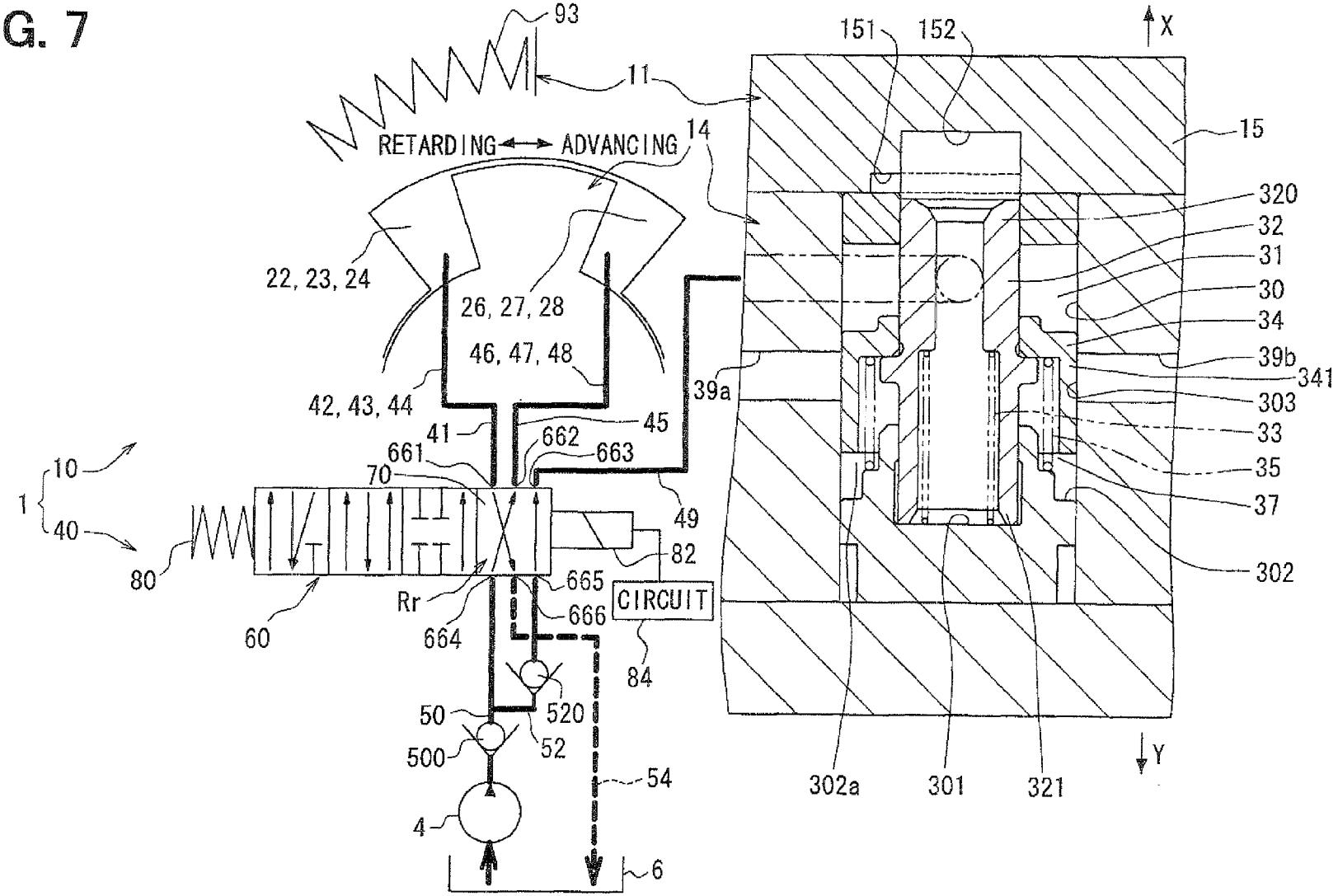
FIG. 7 is a schematic cross sectional view, showing another operational state of the valve timing control apparatus, which is different from those of FIGS. 4 to 6.

Furthermore, when the spool 70 is moved to a retarding range Rr, which is shown in FIGS. 3 and 7 and is located on the fixing portion 64 side of the holding range Rh, the advancing port 661 is communicated with the drain port 666. In this way, the hydraulic oil is drained from the advancing chambers 22-24 into the oil pan 6, which is located on the downstream side of the drain passage 54, through the passages 42, 43, 44, 41 and the ports 661, 666. When the spool 70 is moved to the retarding range Rr, the retarding port 662 is communicated with the primary supply port 664. In this way, the hydraulic oil, which is supplied from the pump 4 to the primary supply passage 50, is guided into the retarding chambers 26-28 through the ports 664, 662 and the passages 45, 46, 47, 48. in addition, when the spool 70 is moved to the retarding range Rr, the lock port 663 is communicated with the secondary supply port 665. In this way, the hydraulic oil, which is supplied from the pump 4 to the primary supply passage 50 and the secondary supply passage 52, is guided into the working chamber 31 thorough the secondary supply port 665, the lock port 663 and the lock passage 49.

Furthermore, a return spring 80, a drive source 82 and a control circuit 84 are provided in the control device 40 shown in FIGS. 1, 4-7 to drive the control valve 60. As shown in FIG. 1, the return spring 80 is a compression coil spring made of metal and is coaxially interposed between a bottom part of the sleeve portion 66, which is located on the fixing portion 64 side, and the land 703 of the spool 70 located on the fixing portion 64 side. The return spring 80 generates a restoring force through compressive deformation of the return spring 80 between the sleeve portion 66 and the spool 70, so that the return spring 80 urges the spool 70 toward the drain port 666 side.

The drive source 82 is a solenoid, which includes a drive shaft 83 made of metal. The drive source 82 is fixed to a chain cover 5 of the engine. The drive shaft 83 is configured into a rod body and is placed on the opposite side of the sleeve portion 66, which is axially opposite from the fixing portion 64, such that the drive shaft 83 is axially reciprocatable. When the drive shaft 83 moves into the drain passage 54 and the drain port 666, the drive shaft 83 coaxially abuts against the spool 70, which receives the restoring force of the return spring 80. The drive source 82 generates a drive force to drive the drive shaft 83 through excitation of a solenoid coil (not shown) upon energization thereof, so that the drive source 82 drives the spool 70. In the present embodiment, when the energization of the solenoid coil is stopped, the spool 70 is moved along with the drive shaft 83 by the restoring force of the return spring 80 and is held in the lock range RI.

The control circuit 84 is an electronic control unit, which includes a microcomputer as its main component. The control circuit 84 is electrically connected to the solenoid coil of the drive source 82. The control circuit 84 controls the moving position of the spool 70 through the energization of the solenoid coil and also controls the operation of the engine.

Figure 8:
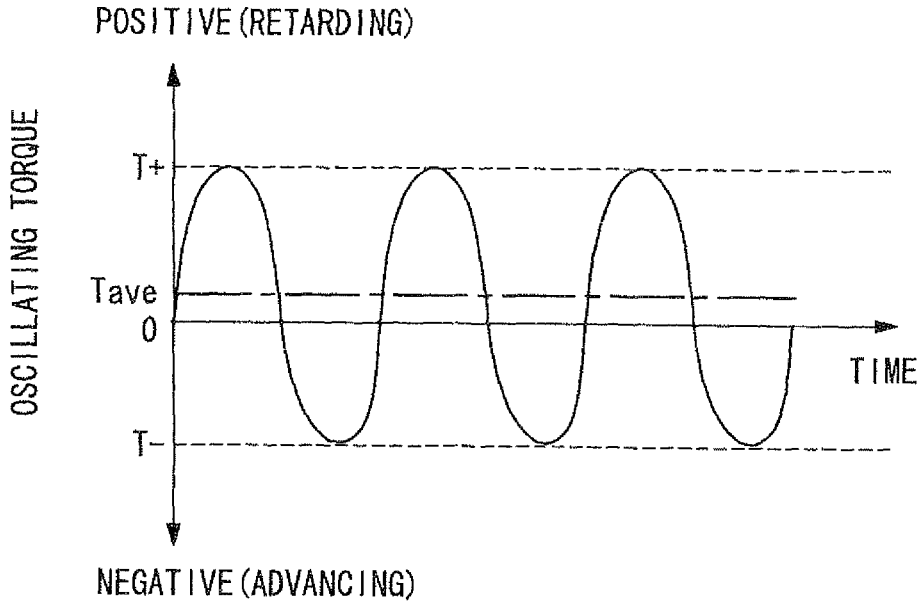
FIG. 8 is a schematic diagram for describing an oscillating torque, which acts on a drive device shown in FIG. 1.

In the drive device 10, which is provided with the camshaft 2 fixed to the rotatable shaft 140 of the vane rotor 14, an oscillating torque is applied to the vane rotor 14 due to, for example, a spring reaction force exerted from the intake valves driven by the camshaft 2 through the rotation of the engine. As shown in FIG. 8, the oscillating torque is generated such that a negative torque, which urges the vane rotor 14 relative to the housing 11 toward the advancing side, and a positive torque, which urges the vane rotor 14 relative to the housing 11 toward the retarding side, are alternately generated. With respect to the oscillating torque of the present embodiment, a peak torque T+ of the positive torque is larger than a peak torque T− of the negative torque due to friction between the camshaft 2 and a bearing (not shown), which supports the camshaft 2. Therefore, an average torque Tave, which is an average of the peak torque T+ of the positive torque and the peak torque T− of the negative torque, is biased on the positive torque side. Therefore, during the rotating period of the engine, the vane rotor 14 is biasedly urged relative to the housing 11 toward the retarding side on average due to the oscillating torque transmitted from the camshaft 2.

Figure 9:
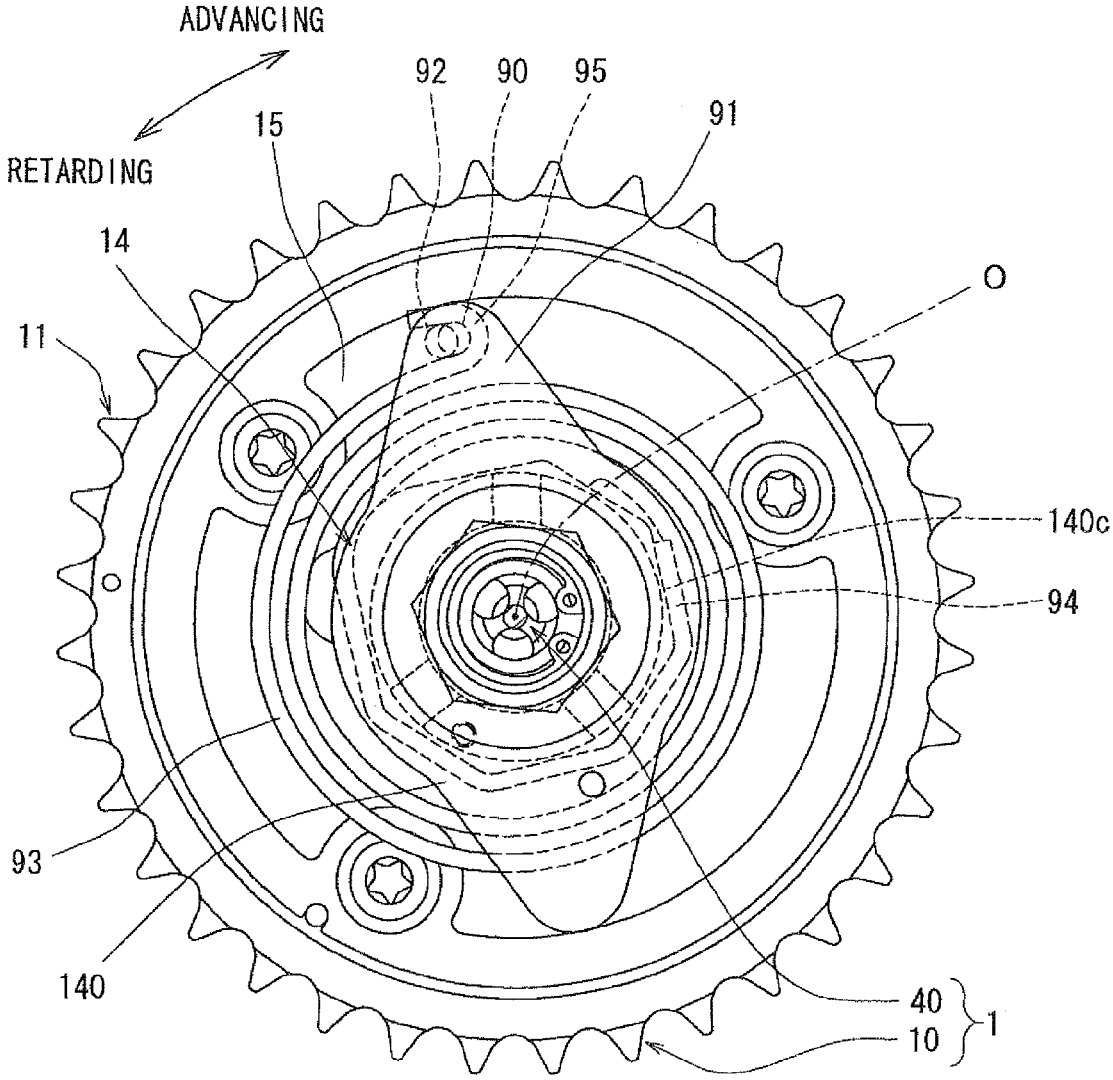
FIG. 9 is a cross sectional view taken along line IX-IX in FIG. 1.

In the drive device 10 shown in FIGS. 1 and 9, a first engaging pin 90 is provided in the front plate 15 of the housing 11. The first engaging pin 90 is made of metal and is configured into a cylindrical body. The first engaging pin 90 projects from the front plate 15 on an opposite axial side, which is opposite from the shoe housing 12. The first engaging pin 90 is eccentric to the central axis O of the rotatable shaft 140 and is substantially parallel to the central axis O of the rotatable shaft 140. An arm 91 and a second engaging pin 92 are provided in the bush 140*c* of the rotatable shaft 140 of the vane rotor 14, which projects on the opposite axial side that is opposite from the shoe housing 12. The arm 91 is made of metal and is configured into a plate form (planar form), which is generally parallel to the front plate 15. The second engaging pin 92 is configured into a cylindrical body, which axially projects from the arm 91 on the front plate 15 side. The second engaging pin 92 is eccentric to the central axis O of the rotatable shaft 140 and is substantially parallel to the central axis O of the rotatable shaft 140. The second engaging pin 92 is placed such that a distance between the central axis of the second engaging pin 92 and the central axis O is substantially the same as a distance between the central axis of the first engaging pin 90 and the central axis O, and the second engaging pin 92 is axially displaced from a rotational moving path of the first engaging pin 90.

An assist spring 93 (see FIGS. 4 to 7) is placed radially outward of the bush 140*c*. The assist spring 93 is made of metal and is a spiral spring, which is formed by winding a spring wire on a plane, (particularly in the present embodiment, the assist spring 93 being a hairspring, in which radially adjacent spring wire segments are radially spaced from each other). A spiral center of the assist spring 93 is coaxial with the central axis O, and the assist spring 93 is placed between the front plate 15 and the arm 91. A radially inner end part 94 of the assist spring 93 is wound around an outer peripheral part of the bush 140*c*. A radially outer end part of the assist spring 93 is bent into a U-shape to form an engaging portion 95. The engaging portion 95 is engageable with a corresponding one of the first engaging pin 90 and the second engaging pin 92 depending on the rotational phase.

Specifically, when the rotational phase of the vane rotor 14 relative to the housing 11 is changed on the retarding side of the lock phase, the engaging portion 95 of the assist spring 93 is engaged with the first engaging pin 90 of the housing 11. At this time, the second engaging pin 92 of the vane rotor 14 is spaced from the engaging portion 95, so that the vane rotor 14 is urged toward the advancing side against the oscillating torque, which is biased to the retarding side (positive torque side) on average, by the restoring force, which is generated by the twist deformation of the assist spring 93 in response to the rotational phase. Specifically, the restoring force of the assist spring 93 in the rotational phase, which is in the retarding side of the lock phase, is set to be larger than the average value of the oscillating torque.

In contrast, when the rotational phase of the vane rotor 14 relative to the housing 11 is changed to the advancing side of the lock phase, the engaging portion 95 of the assist spring 93 is engaged with the second engaging pin 92 of the vane rotor 14. At this time, the first engaging pin 90 of the housing 11 is spaced from the engaging portion 95, so that the urging of the vane rotor 14 by the assist spring 93 is prohibited.

As shown in FIGS. 1 and 2, the housing 11 includes two types of recesses (i.e., a limiting recess and a lock recess) 151, 152, which are recessed from the inner surface 154 of the front plate 15 and cooperate together to form a continuous recess. Among these recesses 151, 152, the limiting recess 151 is formed as a groove, which opens in the inner surface 154 of the front plate 15 and extends in the rotational direction of the housing 11. As shown in FIG. 11, two limiting stoppers 151*a*, 151*b* are formed at two opposed closed ends (opposed circumferential ends) of the limiting recess 151, which are opposed to each other in the extending direction of the limiting recess 151. At a predetermined operational phase, the limiting recess 151 is opposed to and is communicated with the advancing chamber 22, so that the hydraulic oil can flow from the advancing chamber 22 into the limiting recess 151. With reference to FIG. 1, the lock recess 152 is configured into a cylindrical recess, which is eccentric to the central axis O. Furthermore, as shown in FIGS. 10 and 11, the lock recess 152 opens to a bottom part of the limiting recess 151 at an advancing side end part of the limiting recess 151.

As shown in FIGS. 1 and 2, the vane rotor 14 has a receiving hole 30 in the vane 141 of the vane rotor 14. The receiving hole 30 is eccentric to the central axis O and is substantially parallel to the central axis O. The receiving hole 30 opens in an end surface 144 of the vane rotor 14, which is slidable on the inner surface 154 of the front plate 15.

Figure 10:
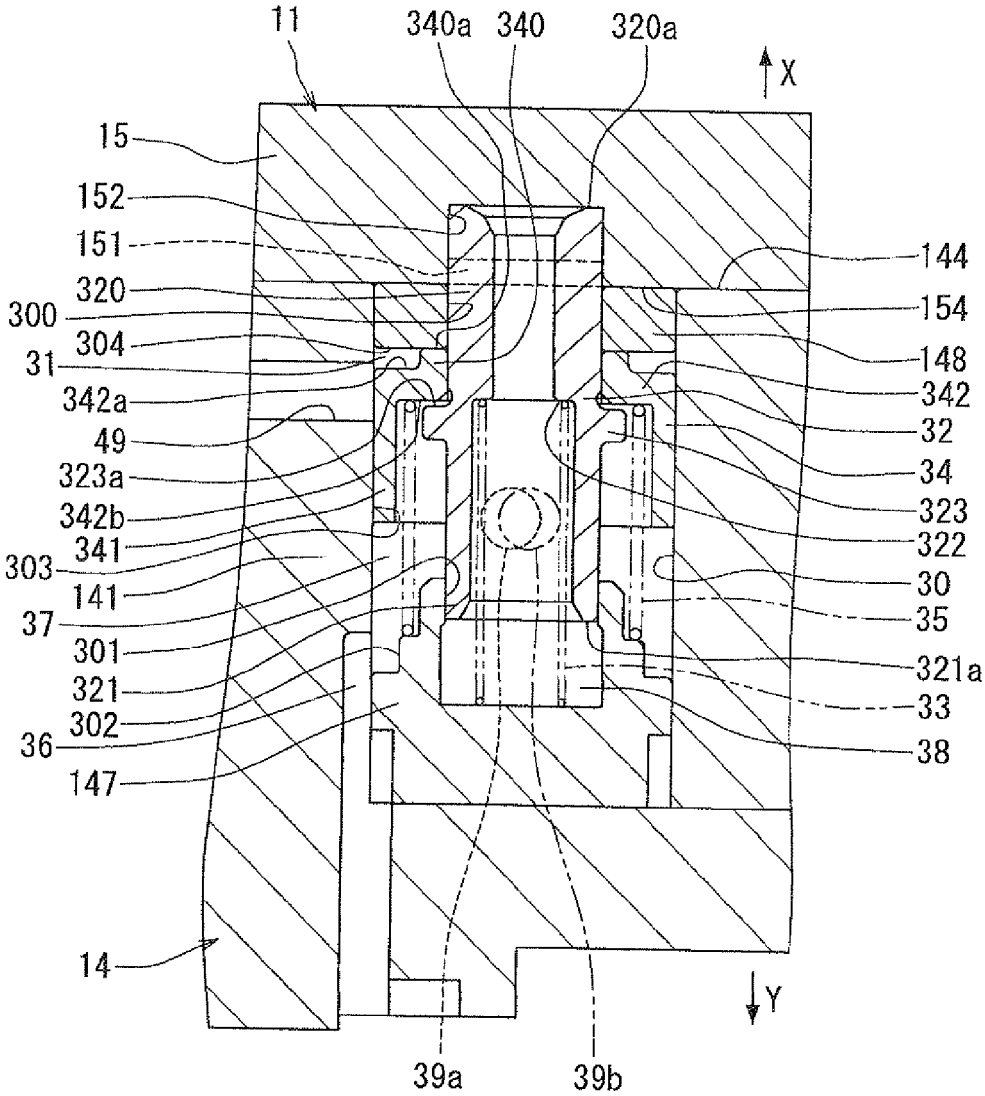
FIG. 10 is a cross-sectional view taken along line I-I in FIG. 2, showing a characteristic feature of the valve timing control apparatus shown in FIG. 1.
Figure 11:
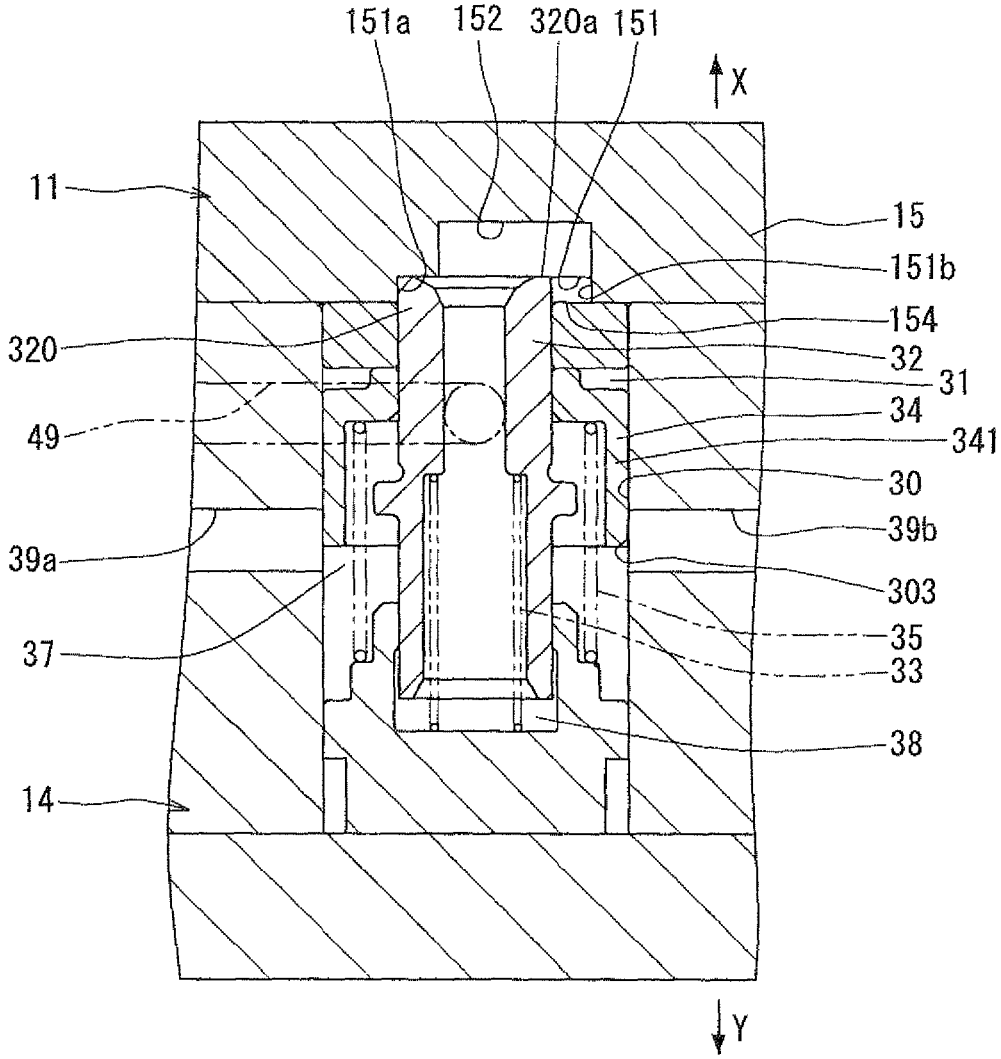
FIG. 11 is a schematic cross sectional view, showing another operational state of the valve timing control apparatus, which is different from those of FIGS. 4 to 7.

As shown in FIG. 10, the receiving hole 30 has a first fitting hole section 300, which is configured into a cylindrical hole and is located at an axial end part (an axial end part in an inserting direction X described later) of the receiving hole 30, which opens toward the front plate 15 that has the recesses 151, 152. The first fitting hole section 300 can be communicated with the limiting recess 151 at a predetermined rotational phase and can be communicated with the lock recess 152 at a predetermined rotational phase. The first fitting hole section 300 of the present embodiment is defined by an inner peripheral part of a cylindrical tubular sleeve 148, which is securely engaged to the base material of the vane rotor 14.

Furthermore, a second fitting hole section 301, which is configured into a cylindrical hole that is coaxial with the first fitting hole section 300, is formed in a closed axial end part (an axial end part in an removing direction Y described later) of the receiving hole 30, which is opposite from the front plate 15. An inner diameter of the second filling hole section 301 is set to be substantially the same as an inner diameter of the first fitting hole section 300. The second fitting hole section 301 of the present embodiment is defined by an inner peripheral part and a bottom part of a cylindrical cup-shaped sleeve 147, which is securely engaged to the base material of the vane rotor 14.

The receiving hole 30 has an annular hole section (annular groove section) 302, which is located radially outward of the second fitting hole section 301 and coaxially surrounds the second fitting hole section 301, at the opposite end part of the receiving hole 30 that is opposite from the front plate 15, Thus, an inner diameter of the annular hole section 302 is set to be larger than the inner diameter of the second fitting hole section 301 by an amount, which is equal to a radial thickness of the sleeve 147. The annular hole section 302 of the present embodiment is defined by an outer peripheral part of the sleeve 147, which defines the second fitting hole section 301.

The receiving hole 30 further includes a third fitting hole section 303. The third fitting hole section 303 is configured into a cylindrical hole and is axially placed between the first fitting hole section 300, which is located on one axial side of the third fitting hole section 303, and the second fitting hole section 301 and the annular hole section 302, which are located on the other axial side of the third fitting hole section 303. Furthermore, the third fitting hole section 303 is coaxial with the first fitting hole section 300, the second fitting hole section 301 and the annular hole section 302. An inner diameter of the third fitting hole section 303 is set to be larger than the inner diameter of the first fitting hole section 300 and the inner diameter of the second fitting hole section 301 and be substantially the same as an outer diameter of the annular hole section 302. With the above settings, at the inner surface of the receiving hole 30, a step surface 304 is formed by an end surface 304 of the sleeve 148. The step surface 304 is located in a boundary between the first fitting hole section 300 and the third fitting hole section 303 and is configured into a planar annular surface (ring surface) that is substantially perpendicular to the first fitting hole section 300 and the third fitting hole section 303. The third fitting hole section 303 of the present embodiment is directly formed in the base material of the vane rotor 14.

Two types of limiting members (a primary limiting member and a secondary limiting member) 32, 34 are received in the receiving hole 30. Among the limiting members 32, 34, a primary limiting member 32 is made of metal and is configured into a cylindrical tubular body. The primary limiting member 32 is eccentric to the central axis O and is substantially parallel to the central axis O (see FIGS. 1 and 2). The primary limiting member 32 includes a first slidable portion 320 and a second slidable portion 321. The first slidable portion 320 is fitted into the first fitting hole section 300, and the second slidable portion 321 is fitted into the second fitting hole section 301. With respect to the primary limiting member 32, which is coaxially held in the receiving hole 30 through the above-described fitting structure, the first slidable portion 320 and the second slidable portion 321 are axially slidable relative to the first fitting hole section 300 and the second fitting hole section 301, respectively, so that the first slidable portion 320 can be moved into or out of the recesses 151, 152. In the present embodiment, the axial moving direction (upward direction in FIG. 10) of the primary limiting member 32 toward the interior of the recesses 151, 152 is defined as the inserting direction X, and the axial moving direction (downward direction in FIG. 10) of the primary limiting member 32 away from the recesses 151, 152 is defined as the removing direction Y.

An axial end surface of the first slidable portion 320, which is directed in the inserting direction X, serves as a first end surface 320*a* of the primary limiting member 32. The first end surface 320*a* can be axially opposed to the limiting recess 151 at the corresponding predetermined rotational phase and can be axially opposed to the lock recess 152 at the corresponding predetermined rotational phase (see FIGS. 4, 11 and 12). An axial end surface of the second slidable portion 321, which is directed in the removing direction Y, serves as a second end surface 321*a* of the primary limiting member 32. The second end surface 321*a* is exposed to a back pressure chamber 38, which is defined between the second fitting hole section 301 and the second slidable portion 321. Furthermore, a center hole of the primary limiting member 32, which axially extends through the first end surface 320*a* and the second end surface 321*a*, forms a cylindrical through-hole 322 of the primary limiting member 32. Therefore, in the present embodiment, the hydraulic oil can flow from the recesses 151, 152 into the through-hole 322 and the back pressure chamber 38 of the second fitting hole section 301, so that the pressure of the hydraulic oil is exerted to the first and second end surfaces 320*a*, 321*a* and the inner surface of the through-hole 322.

Here, an inner diameter of a portion of the through-hole 322, which is located in the first slidable portion 320, is set to be smaller than an inner diameter of another portion of the through-hole 322, which is located in the second slidable portion 321. An outer diameter of the first slidable portion 320 and an outer diameter of the second slidable portion 321 are substantially equal to each other. With the above diameter settings, according to the present embodiment, the force, which is applied to the primary limiting member 32 in the inserting direction X, and the force, which is applied to the primary limiting member 32 in the removing direction Y, are substantially equal to each other upon the application of the pressure of the hydraulic oil to the first and second end surfaces 320*a*, 321*a* and the inner surface of the through-hole 322. That is, the force, which is applied to the primary limiting member 32 in the inserting direction X, and the force, which is applied to the primary limiting member 32 in the removing direction Y, will be canceled with each other upon the application of the pressure of the hydraulic oil to the first and second end surfaces 320*a*, 321*a* and the inner surface of the through-hole 322.

In addition, the primary limiting member 32 includes a projection (flange) 323, which radially outward projects from an axial middle part of the primary limiting member 32 (the first slidable portion 320 side end part of the second slidable portion 321). The projection 323 is configured into an annular plate form, which continuously extends in the circumferential direction of the primary limiting member 32 all around the primary limiting member 32. A planar annular surface 323*a* of the projection 323, which is substantially perpendicular to the first and second slidable portions 320, 321, is directed in the inserting direction X.

Figure 12:
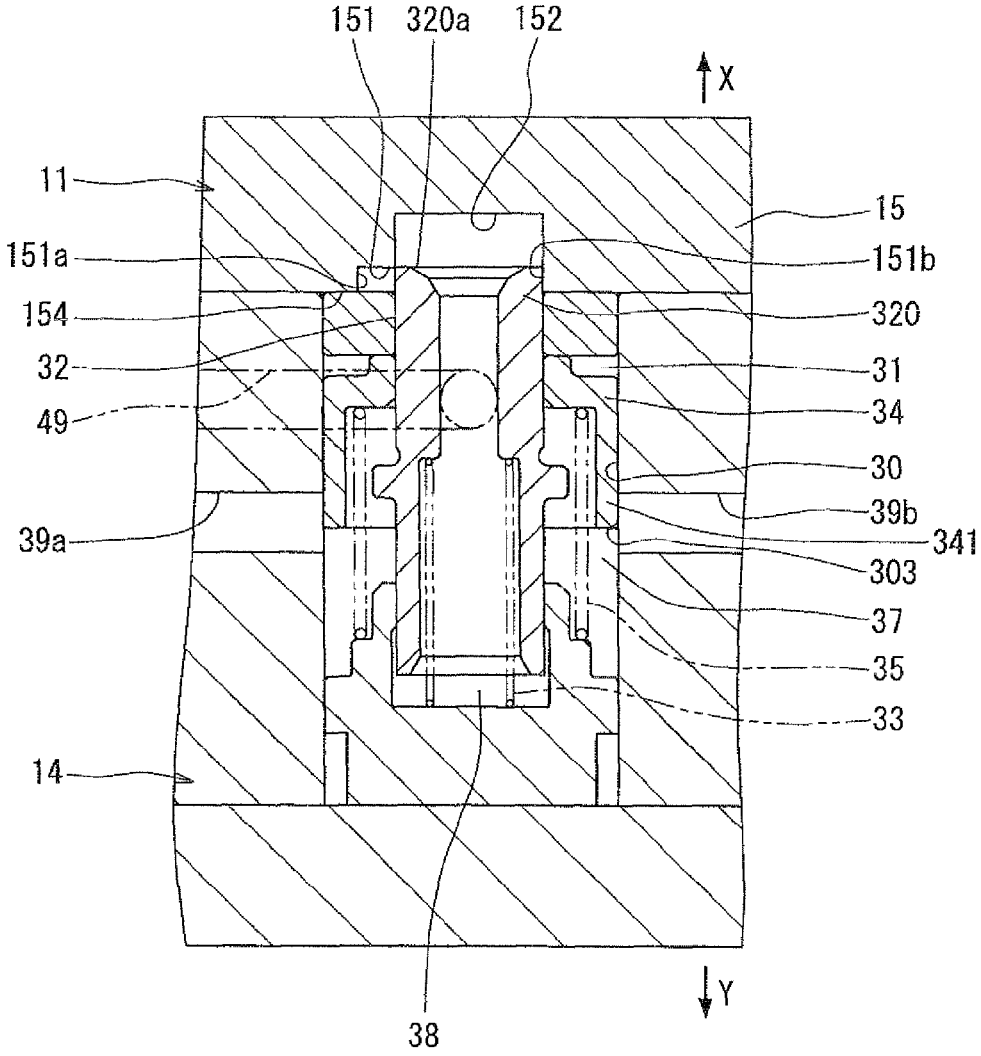
FIG. 12 is a schematic cross sectional view, showing another operational state of the valve timing control apparatus, which is different from those of FIGS. 4 to 7 and 11.

When the primary limiting member 32 is axially moved in the inserting direction X on the retarding side of the lock phase in the limited phase range, the first slidable portion 320 of the primary limiting member 32 is received in the limiting recess 151, as shown in FIGS. 11 and 12. As shown in FIG. 11, when the primary limiting member 32, which is received in the limiting recess 151, is engaged with the limiting stopper 151*a*, which is located at the retarding side end part of the limiting recess 151, a change in the rotational phase in the retarding side is limited at a retarding side limited phase in the limited phase range. Furthermore, as shown in FIG. 12, when the primary limiting member 32, which is received in the limiting recess 151, is engaged with the limiting stopper 151*b*, which is located at the advancing side end part of the limiting recess 151, a change in the rotational phase in the advancing side is limited at the lock phase in the limited phase range.

Furthermore, when the primary limiting member 32 is further moved from the limiting recess 151 in the inserting direction X in the lock phase, the first slidable portion 320 of the primary limiting member 32 is inserted into and is thereby received in the lock recess 152, as shown in FIGS. 4 and 10. The primary limiting member 32, which is received in the lock recess 152, limits a change in the rotational phase toward the advancing side and the retarding side, so that the rotational phase is limited to the lock phase.

Furthermore, when the primary limiting member 32 is moved in the removing direction Y in the limited phase range, which includes the lock phase, the first slidable portion 320 of the primary limiting member 32 is removed from both of the lock recess 152 and the limiting recess 151, as shown in FIGS. 5 to 7. When the primary limiting member 32 is removed from the recesses 152, 151, the limitation on the rotational phase is cleared, so that the rotational phase can be changed to any desirable rotational phase, that is, the free valve timing adjustment is allowed.

In contrast to the primary limiting member 32, as shown in FIG. 10, the secondary limiting member 34 is made of metal and is configured into a stepped cylindrical tubular body. The secondary limiting member 34 is eccentric to the central axis O and is substantially parallel to the central axis O (see FIG. 1). The secondary limiting member 34 includes a radially inner slidable portion 340 and a radially outer slidable portion 341. The radially inner slidable portion 340 is slidably fitted to an outer peripheral part of the first slidable portion 320 of the primary limiting member 32. The radially outer slidable portion 341 is located on the one axial side of the radially inner slidable portion 340, which is opposite from the recesses 151, 152 in the removing direction Y, and the radially outer slidable portion 341 is slidably fitted to the third fitting hole section 303 of the receiving hole 30. An inner diameter and an outer diameter of the radially outer slidable portion 341 are set to be larger than an inner diameter and an outer diameter, respectively, of the radially inner slidable portion 340.

With the fitting structure and the diameter settings described above, the secondary limiting member 34, which is coaxially held in the receiving hole 30 and into which the primary limiting member 32 is fitted, can be axially moved in both of the inserting direction X and the removing direction Y such that the radially inner slidable portion 340 is axially moved integrally with the first slidable portion 320 or is axially slide relative to the first slidable portion 320. When the radially outer slidable portion 341 slides along and axially reciprocates relative to the third fitting hole section 303 in the removing direction Y or the inserting direction X, the radially outer slidable portion 341 is moved into the annular hole section 302 of the receiving hole 30 (see FIGS. 5 to 7) or is moved out of the annular hole section 302 of the receiving hole 30 (see FIGS. 4 and 10). When the radially outer slidable portion 341 is constructed to be moved into or out of the annular hole section 302 in the above described manner, the size of the vane rotor 14, which receives the secondary limiting member 34 in the receiving hole 30, can be reduced in the moving direction of the secondary limiting member 34 while ensuring the required moving stroke of the secondary limiting member 34. Therefore, although it is sometimes difficult to have the installation space of the valve timing control apparatus around the engine in general, the installability of the valve timing control apparatus 1 of the present embodiment can be improved by reducing the size of the valve timing control apparatus 1 in the above described manner.

Furthermore, as shown in FIG. 10, the secondary limiting member 34 includes an annular connecting portion 342, which is configured into an annular plate form and connects between the radially inner slidable portion 340 and the radially outer slidable portion 341. The third fitting hole section 303 forms the working chamber 31 at the location, which is on one axial side of the connecting portion 342 in the inserting direction X. The working chamber 31 is communicated with the lock passage 49, which extends through the vane rotor 14. A planar annular surface 342*a* of the connecting portion 342, which is substantially perpendicular to the slidable portions 340, 341 and is directed in the inserting direction X, is exposed in the working chamber 31 and is always opposed to the step surface 304 of the receiving hole 30. In this way, the planar annular surface 342*a* of the connecting portion 342 serves as a pressure receiving surface that receives the hydraulic oil (the hydraulic oil guided from the lock passage 49 to the working chamber 31) in the removing direction Y. Therefore, when the pressure receiving surface 342*a* receives the pressure in the removing direction Y, the drive force, which drives the secondary limiting member 34 in the removing direction Y, is generated.

Figure 13A:
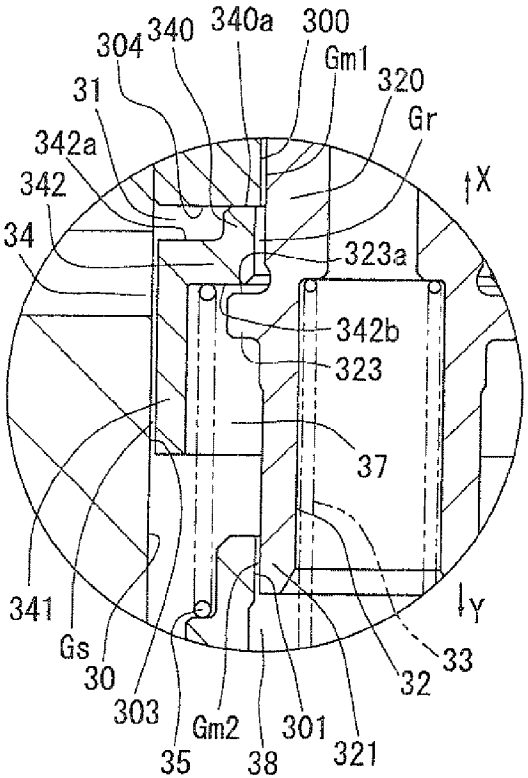
FIGS. 13A to 13C are partially enlarged cross-sectional views showing various different operational states of the valve timing control apparatus shown in FIG. 1.
Figure 13B:
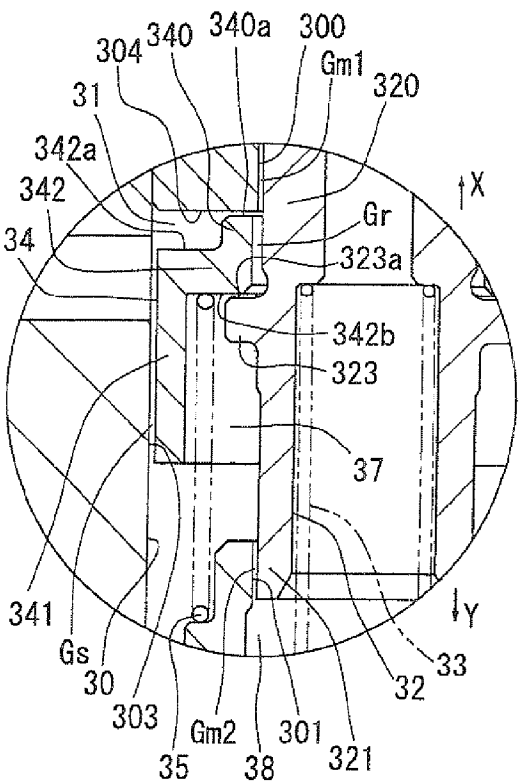
Figure 13C:
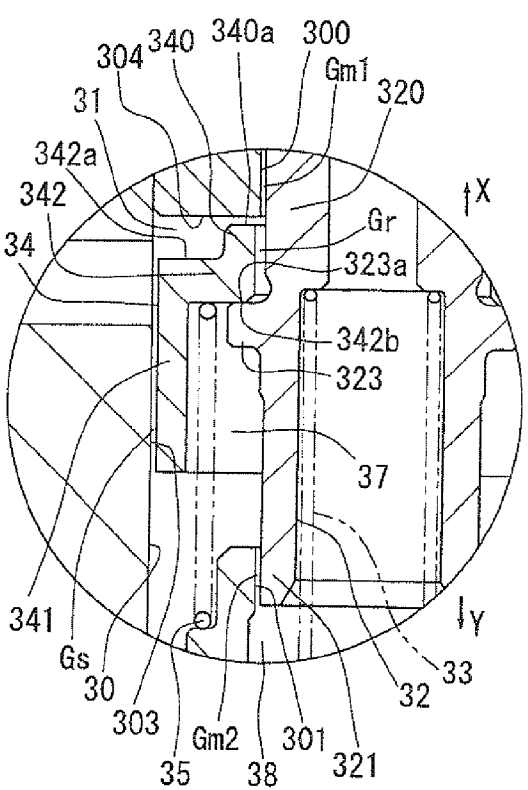

Furthermore, an axial end surface of the radially inner slidable portion 340, which is projected away from the connecting portion 342 in the inserting direction X, forms a stopper surface 340*a*. The stopper surface 340*a* is substantially parallel to the step surface 304 of the receiving hole 30. The stopper surface 340*a* can be spaced from the step surface 304 in the removing direction Y or can abut against the step surface 304 to form a surface-to-surface contact therebetween. With reference to FIGS. 13B and 13C, when the stopper surface 340*a* is spaced from the step surface 304 and is exposed in the working chamber 31 to receive the pressure of the hydraulic oil in the removing direction Y, a larger drive force is generated to drive the secondary limiting member 34 in the removing direction Y by the pressure of the hydraulic oil applied to the stopper surface 340*a* in corporation with the pressure of the hydraulic oil applied to the pressure perceiving surface 342*a*. Furthermore, as shown in FIG. 13A, in the engaged state of the stopper surface 340*a*, in which the stopper surface 340*a* contacts and engages the step surface 304, the stopper surface 340*a* is not exposed in the working chamber 31. Therefore, the pressure of the hydraulic oil in the removing direction Y in the working chamber 31 is applied only to the pressure receiving surface 342*a*, and thereby the smaller drive force is generated to drive the secondary limiting member 34 in the removing direction Y.

Furthermore, as shown in FIG. 10, the third fitting hole section 303 forms an atmospheric chamber 37 on the opposite axial side of the connecting portion 342 of the secondary limiting member 34, which is opposite from the recesses 151, 152 in the removing direction Y. The atmospheric chamber 37 is communicated with an atmosphere communication passage 36, which extends through the vane rotor 14, through the annular hole section 302. The atmosphere communication passage 36 opens to the outside of the drive device 10, and the atmospheric chamber 37 opens to the atmosphere through the atmosphere communication passage 36 and the annular hole section 302. When the atmospheric chamber 37, which opens to the atmosphere, is formed on the opposite side of the secondary limiting member 34, which is opposite from the working chamber 31 in the removing direction Y, the secondary limiting member 34 can be more effectively and rapidly moved in response to a change in the pressure of the hydraulic oil in the working chamber 31. As shown in FIGS. 5 to 7, according to the present embodiment, a space 302*a* is provided between the annular hole section 302 and the secondary limiting member 34, which is received in the annular hole section 302 and is placed in the end of the movable range of the secondary limiting member 34 in the removing direction Y. Thereby, the atmosphere open state (state of being communicated with the atmosphere) of the atmospheric chamber 37 is always maintained.

In addition, with reference to FIG. 10, a planar annular surface 342*b* of the connecting portion 342 of the secondary limiting member 34, which is substantially perpendicular to the slidable portions 340, 341 and is directed in the removing direction Y, is exposed in the atmospheric chamber 37 in the inside of the radially outer slidable portion 341. In this way, the planar annular surface 342*b* of the connecting portion 342 serves as an engaging surface that is generally parallel to the planar annular surface 323*a* of the projection 323 of the primary limiting member 32, which projects into the atmospheric chamber 37. The engaging surface 342*b* of the connecting portion 342 can be spaced from the planar annular surface 323*a* of the projection 323 in the inserting direction X and can be engaged with the planar annular surface 323*a* of the projection 323 in the removing direction Y through the surface-to-surface contact.

Therefore, with reference to FIG. 13C, in the engaged state where the engaging surface 342*b* of the connecting portion 342 is engaged with the planar annular surface 323*a* of the projection 323 in the removing direction Y, when the drive force, which is exerted against the secondary limiting member 34 by the pressure of the hydraulic fluid in the working chamber 31, is conducted ,o the primary limiting member 32, the primary limiting member 32 and the secondary limiting member 34 can be integrally driven in the removing direction Y. Through this integral driving of the primary and secondary limiting members 32, 34, the secondary limiting member 34 is moved to the end of the movable range thereof in the removing direction Y until the second slidable portion 321 contacts the bottom part of the second fitting hole section 301, so that the radially outer slidable portion 341 of the secondary limiting member 34 is received in the annular hole section 302 and reaches the end of the movable range thereof in the removing direction Y to define the space 302*a*.

Here, as shown in FIG. 11, an advancing communication passage 39*a* and a retarding communication passage 39*b*, which are formed to extend through the vane rotor 14 and are communicated with the advancing chamber 22 and the retarding chamber 26, respectively, are opened in the interior of the third fitting hole section 303, along which the radially outer slidable portion 341 of the secondary limiting member 34 slides (see FIG. 2). When the secondary limiting member 34 is moved to the end (serving as a blocking position) of the movable range thereof in the removing direction Y, as shown in FIGS. 5 to 7, the opening of the advancing communication passage 39*a* and the opening of the retarding communication passage 39*b* are closed by the radially outer slidable portion 341 to disconnect the advancing communication passage 39*a* and the retarding communication passage 39*b* from the atmospheric chamber 37 of the third fitting hole section 303. Furthermore, when the secondary limiting member 34 is moved in the inserting direction X from the blocking position, as shown in FIGS. 4, 10-12 and 14, the radially outer slidable member 341 is removed from the opening of the advancing communication passage 39*a* and the opening of the retarding communication passage 39*b*, so that the advancing communication passage 39*a* and the retarding communication passage 39*b* are communicated with the atmospheric chamber 37.

Figure 15:
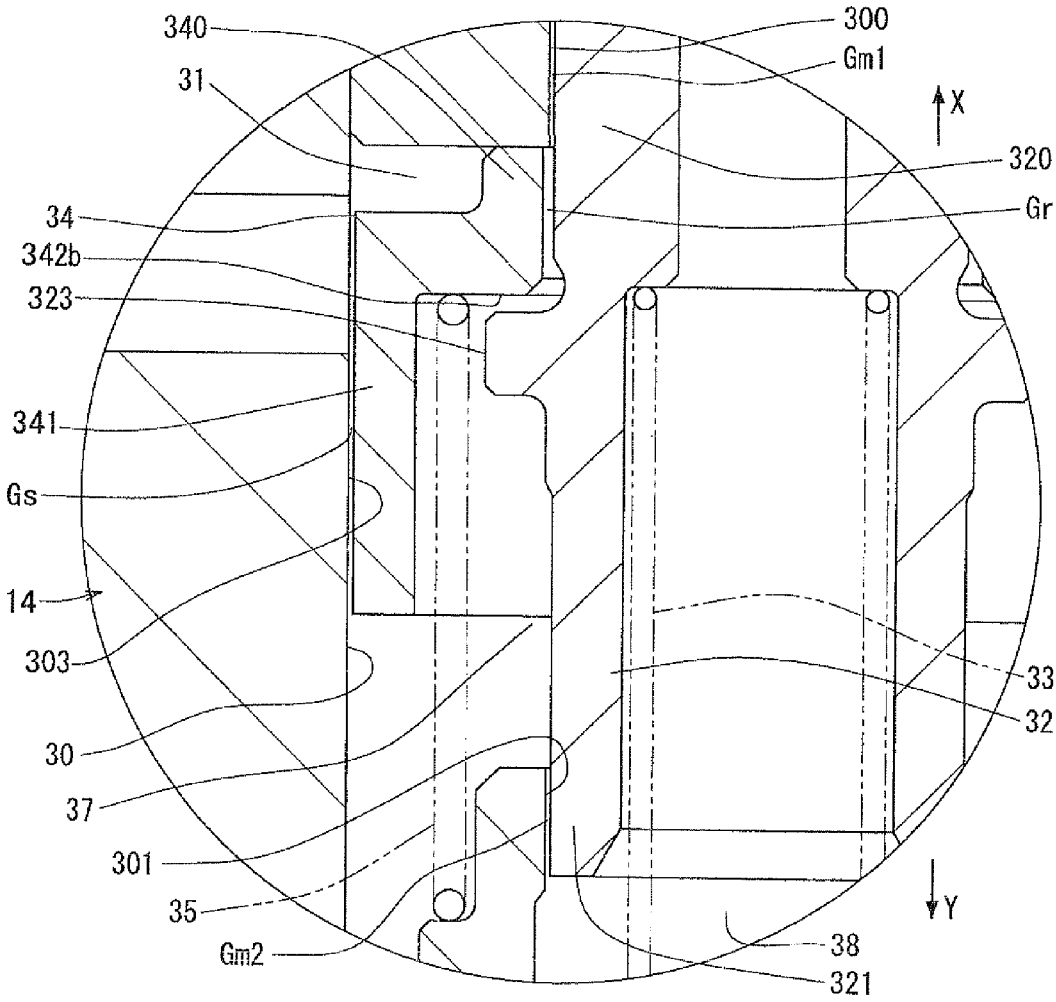
FIG. 15 is a partial enlarged cross-sectional view, showing a main feature indicated in FIG. 10.

As shown in FIG. 15, a secondary slide gap (radial gap) Gs is radially defined between an outer peripheral part (outer peripheral wall surface) of the radially outer slidable portion 341 of the secondary limiting member 34 and an inner peripheral part (inner peripheral wall surface) of the third fitting hole section 303 to enable the reciprocating slide movement of the radially outer slidable portion 341 relative to the third fitting hole section 303. The secondary slide gap Gs is placed adjacent to and is communicated with the working chamber 31 and the atmospheric chamber 37. A first primary slide gap (radial gap) Gm1 is radially defined between an outer peripheral part (outer peripheral wall surface) of the first slidable portion 320 of the primary limiting member 32 and an inner peripheral part (inner peripheral wall surface) of the first fitting hole section 300 to enable the reciprocating slide movement of the first slidable portion 320 relative to the first fitting hole section 300. The first primary slide gap Gm1 is placed adjacent to and is communicated with the working chamber 31 in the state where the stopper surface 340*a* is spaced from the step surface 304 (see FIGS. 13B and 13C). A second primary slide gap (radial gap) Gm2 is radially defined between an outer peripheral part (outer peripheral wall surface) of the second slidable portion 321 of the primary limiting member 32 and an inner peripheral part (inner peripheral wall surface) of the second fitting hole section 301 to enable the reciprocating slide movement of the second slidable portion 321 relative to the second fitting hole section 301. The second primary slide gap Gm2 is placed adjacent to and is communicated with the atmospheric chamber 37 and the back pressure chamber 38.

A relative slide gap (radial gap) Gr is radially defined between the outer peripheral part (outer peripheral wall surface) of the first slidable portion 320 and an inner peripheral portion (inner peripheral wall surface) of the radially inner slidable portion 340 of the secondary limiting member 34 to enable the reciprocating slide movement between the first slidable portion 320 and the radially inner slidable portion 340. The relative slide gap Gr is placed adjacent to and is communicated with the atmospheric chamber 37 in the state where the stopper surface 340*a* contacts the step surface 304, and the engaging surface 342*b* is spaced from the projection 323 (see FIG. 13A). The relative slide gap Gr is placed adjacent to and is communicated with the working chamber 31 and the atmospheric chamber 37 in the state where the stopper surface 340*a* is spaced from the step surface 304, and the engaging surface 342*b* is spaced from the projection 323 (see FIG. 13B). In the state where the stopper surface 340*a* is spaced from the step surface 304, and the engaging surface 342*b* is engaged with the projection 323 (see FIG. 13C), the relative slide gap Gr is placed adjacent to the working chamber 31 but is fluid-tightly sealed relative to the atmospheric chamber 37.

As shown in FIG. 15, a radial size of the relative slide gap Gr is set to be larger than a radial size of the secondary slide gap Gs and a radial size of the first and second primary slide gaps Gm1, Gm2. Particularly, the radial size of the first primary slide gap Gm1 and the radial size of the second primary slide gap Gm2 are set to be substantially equal to each other as long as the radial size of the first primary slide gap Gm1 and the radial size of the second primary slide gap Gm2 are smaller than the relative slide gap Gr. Furthermore, in the present embodiment, the radial size of the first primary slide gap Gm1 and the radial size of the second primary slide gap Gm2 are also set to be substantially equal to the radial size of the secondary slide gap Gs. In this particular embodiment, the radial size of the relative slide gap Gr is set to be about 50 μm, and the radial size of the secondary slide gap Gs, the radial size of the first primary slide gap Gm1 and the radial size of the second primary slide gap Gm2 are set to be about 20 μm.

Figure 14:
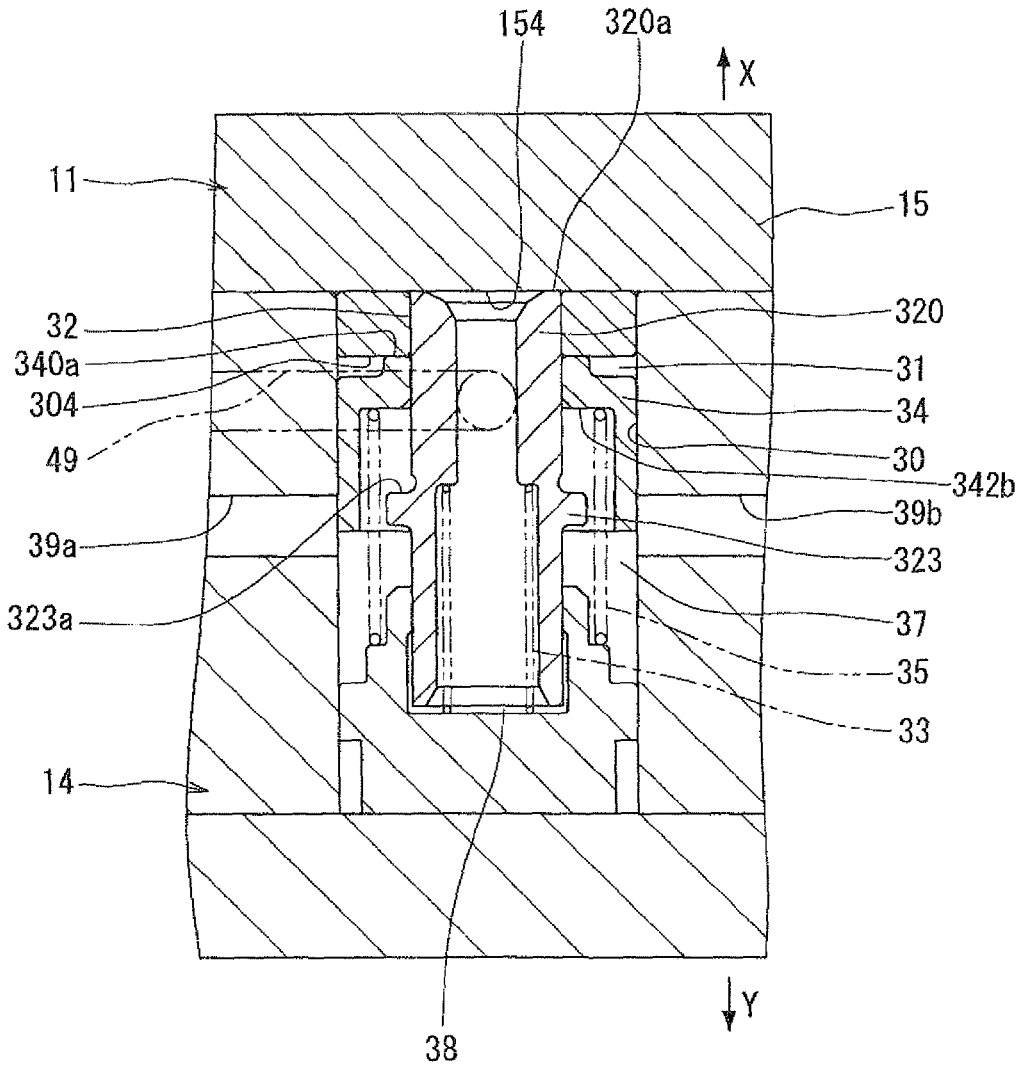
FIG. 14 is a schematic cross sectional view, showing another operational state of the valve timing control apparatus, which is different from those of FIGS. 4 to 7, 11 and 12.

In addition to the structure described above, two types of resilient members (i.e., a primary resilient member and a secondary resilient member) 33, 35 are received in the receiving hole 30, as shown in FIG. 1. As shown in FIG. 10, the primary resilient member 33 is a compression coil spring made of metal. The primary resilient member 33 is interposed between the second fitting hole section 301 and the through-hole 322 of the primary limiting member 32. The primary resilient member 33 generates a restoring force through compression deformation thereof between the second fitting hole section 301 and the through-hole 322, so that the primary resilient member 33 urges the primary resilient member 33 in the inserting direction X. Therefore, for example, in the rotational phase (e.g., the most retarded phase) on the retarding side of the limited phase range, the primary limiting member 32 is moved in the inserting direction X by the restoring force of the primary resilient member 33, so that the first end surface 320*a* of the limiting member 32 can contact the inner surface 154 of the front plate 15, as shown in FIG. 14. Furthermore, in the limited phase range, when the primary limiting member 32 is moved in the inserting direction X by the restoring force of the primary resilient member 33, the first slidable portion 320 of the primary limiting member 32 can be inserted into each corresponding one(s) of the recesses 151, 152 depending on the current rotational phase, as shown in FIGS. 10 to 12. Furthermore, as shown FIG. 13C, in the engaged state where the engaging surface 342*b* is engaged with the projection 323 in the removing direction Y, the projection 323 is urged against the engaging surface 342*b* by the restoring force of the primary resilient member 33. Thereby, the primary limiting member 32 and the secondary limiting member 34 can be integrally driven in the inserting direction X.

In contrast to the primary resilient member 33, the secondary resilient member 35, which is made of metal and is formed as a compression coil spring, is interposed between the annular hole section 302 and the connecting portion 342 of the secondary limiting member 34, as shown in FIG. 10. When the secondary resilient member 35 generates the restoring force through the compression deformation thereof between the annular hole section 302 and the connecting portion 342 of the secondary limiting member 34, the secondary resilient member 35 urges the secondary limiting member 34 in the inserting direction X. Therefore, even on the retarding side of the limited phase range, the engaging surface 342*b* can be spaced away from the projection 323 in the inserting direction X upon movement of the secondary limiting member 34 by the restoring force of the secondary resilient member 35 in the state where the primary limiting member 32 contacts the inner surface 154 of the front plate 15, as shown in FIG. 14. Furthermore, in the lock phase of the limited phase range, even in the state where the primary limiting member 32 is inserted into the recesses 151, 152 as shown in FIG. 10, the engaging surface 342*b* of the secondary limiting member 34, which receives the restoring force of the secondary resilient member 35, can be spaced away from the projection 323 in the inserting direction X. Furthermore, in the state where the engaging surface 342*b* of the secondary limiting member 34 is spaced away from the projection 323, the stopper surface 340*a* of the secondary limiting member 34 is engaged with the step surface 304 of the receiving hole 30, as shown in FIGS. 10 and 14, so that the movement of the secondary limiting member 34 in the inserting direction X is limited.

Hereinafter, the entire operation of the valve timing control apparatus 1 will be described.

First of all, there will be described the normal operation, during which the engine is operated normally.

(I) When the engine is stopped normally based on an engine stop command (e.g., an off command of an engine switch of the vehicle), the control circuit 84 controls the energization of the drive source 82 to move the spool 70 of the control valve 60 to the lock range RI shown in FIG. 4. At this time, the engine, which is still under inertial rotation until the time of full stop, is decelerated, and thereby the rotational speed of the engine decreases. Thus, the pressure of the hydraulic oil, which is guided from the pump 4 into the advancing chambers 22-24 through the passages 50, 41, 42, 43, 44, is also reduced. Furthermore, at this time, the hydraulic oil of the working chamber 31 is drained into the oil pan 6 thorough the passages 49, 54. Therefore, the drive force, which drives the secondary limiting member 34 in the removing direction Y, is lost. As a result, the secondary limiting member 34, which receives the restoring force of the secondary resilient member 35, is moved in the inserting direction X and thereby pushes the remaining hydraulic oil, which remains in the working chamber 31, toward the lock passage 49. Then, the stopper surface 340*a* of the secondary limiting member 34 contacts the step surface 304 of the receiving hole 30 (see FIGS. 10 and 11). Furthermore, in addition to this movement of the secondary limiting member 34, the primary limiting member 32 receives the restoring force of the primary resilient member 33. Thus, the projection 323 of the primary limiting member 32 is urged to contact the engaging surface 342*b* of the secondary limiting member 34, and the primary limiting member 32 is kept moved in the inserting direction X. Thus, as discussed below, the lock phase is implemented upon the operation, which is performed depending on the rotational phase, which is held at the time of receiving the engine stop command, as discussed below.

(I-1) In the case where the rotational phase, which is held at the time of receiving the engine stop command, is on the retarding side of the lock phase, the vane rotor 14 is rotated toward the advancing side relative to the housing 11 by the negative torque component of the oscillating torque, which is generated by the inertial rotation of the engine, and the restoring force of the assist spring 93. Thus, when the rotational phase progressively changes toward the advancing side and finally reaches the retarding side limit phase within the limited phase range, the primary limiting member 32 is urged by the restoring force of the primary resilient member 33, so that the primary resilient member 33 is inserted into the limiting recess 151 and contacts the limiting stopper 151*a*. As a result, a change of the rotational phase toward the retarding side beyond the retarding side limit phase is limited, as shown in FIG. 11. Furthermore, when the rotational phase reaches the lock phase in the limited phase range upon the progressive change of the rotational phase toward the advancing side, the primary limiting member 32 contacts the limiting stopper 151 b of the limiting recess 151, into which the primary limiting member 32 is received, as shown in FIG. 12. Then, in this state where the primary limiting member 32 contacts the limiting stopper 151*b* of the limiting recess 151, the primary limiting member 32 is further urged and is inserted into the lock recess 152 by the restoring force of the primary resilient member 33, as shown in FIG. 10, so that the rotational phase is limited to the lock phase. At this time, the secondary limiting member 34, which contacts the step surface 304 upon the application of the restoring force of the secondary resilient member 35, is held such that the engaging surface 342*b* of the secondary limiting member 34 is spaced in the inserting direction X from the projection 323 of the primary limiting member 32, which is received in the lock recess 152.

(I-2) In the case where the rotational phase, which is held at the time of receiving the engine stop command, is the lock phase, the primary limiting member 32 is urged into and is received in the limiting recess 151 and the lock recess 152 in the inserting direction X, as shown in FIG. 10. Thus, the primary limiting member 32 contacts the limiting stopper 151*b* of the limiting recess 151 and is received in the lock recess 152, so that the rotational phase is limited at the lock phase.

(I-3) In the case where the rotational phase, which is held at the time of receiving the engine stop command, is on the advancing side of the lock phase, the vane rotor 14 is rotated relative to the housing 11 toward the retarding side by the oscillating torque that is biased on the positive torque side (retarding side) on average by the inertial rotation of the engine. Thus, when the rotational phase progressively changes and finally reaches the lock phase in the limited phase range, the primary limiting member 32 is urged into and is inserted into the limiting recess 151 and the lock recess 152 in the inserting direction X, as shown in FIG. 10. Thereby, the rotational phase is limited at the lock phase.

(II) In a starting period of the engine, which is started by cranking the engine in response to the engine start command (e.g., the turning on of the engine switch of the vehicle) after the normal stop of the engine, the control circuit 84 controls the electric power supply to the drive source 82 to move the spool 70 of the control valve 60 to the lock range RI of FIG. 4. Then, although the operation of the pump 4 has started in response to the start of the engine, the hydraulic oil is not guided from the pump 4 to the passages 49, 54 (the drain path for draining the hydraulic oil to the oil pan 6) and the working chamber 31. Therefore, the drive force, which drives the secondary limiting member 34 in the removing direction Y, is lost. As a result, the primary limiting member 32, which receives the restoring force of the primary resilient member 33, is kept in its received state where the primary limiting member 32 is received in the recesses 151, 152, so that the rotational phase is limited at the lock phase. Furthermore, at this time, although the hydraulic oil from the pump 4 is supplied to the advancing chambers 22-24 through the passages 50, 41, 42, 43, 44, the pressure of the supplied hydraulic oil is still low during the engine start period, and the quantity of the supplied hydraulic oil is throttled, i.e., is reduced by the throttling portion 704 of the control valve 60. Thus, even when the hydraulic oil to be supplied to the advancing chambers 22-24 leaks into the working chamber 31 due to an abnormality, the limited state of the rotational phase is maintained, i.e., is held. Because of the holding of the limited state of the rotational phase, the lock phase, which is most suitable for the engine start in the limited phase range, can be reliably implemented during the engine start period.

In the engine start period, due to the oscillating torque, which forces the vane rotor 14 to rotate relative to the housing 11, a shearing force (shearing stress) may possibly be applied to the primary limiting member 32, which is received in the lock recess 152. However, as shown in FIG. 10, when the primary limiting member 32 is held by both of the first fitting hole section 300, which is located closer to the lock recess 152 in the inserting direction X, and the second fitting hole section 301, which is further from the lock recess 152 in the removing direction Y, the shearing force, which is applied to the primary limiting member 32, can be spread and reduced at the further side (side where the second fitting hole section 301 is located). Thus, the durability of the primary limiting member 32 can be increased.

Figure 16:
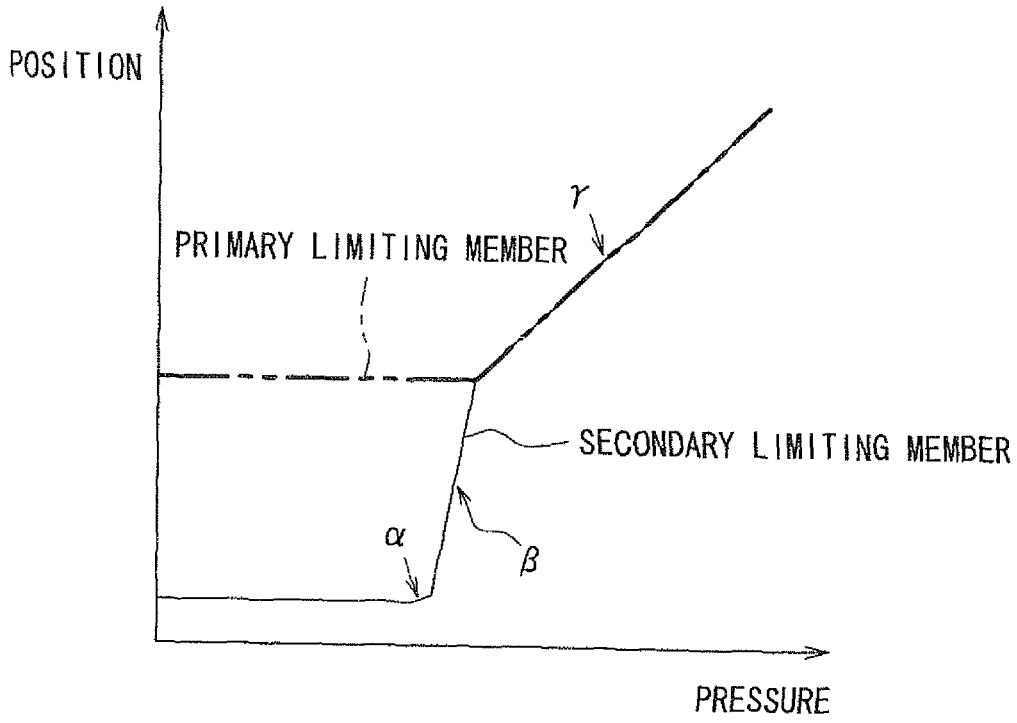
FIG. 16 is a schematic diagram for describing the operation of the valve timing control apparatus shown in FIG. 1.

(III) When the engine start period after the normal stop of the engine ends, the control circuit 84 controls the electric power supply to the drive source 82, so that the spool 70 of the control valve 60 is moved into the holding range Rh. Thus, the pressure of the hydraulic oil, which is pumped from the pump 4, is increased by the idling rotation of the engine after the completion of the engine start, and thereby the hydraulic fluid is guided from the pump 4 into the working chamber 31 through the passages 50, 52, 49. Therefore, the drive force, which drives the secondary limiting member 34 in the removing direction Y is generated. At this time, as shown in FIG. 13A, the secondary limiting member 34 is placed in the state where the stopper surface 340*a* of the secondary limiting member 34 contacts the step surface 304. Therefore, the pressure of the hydraulic oil in the working chamber 31 is received only by the pressure receiving surface 342*a* of the secondary limiting member 34 in the removing direction Y, and the secondary limiting member 34 begins to move in the removing direction Y against the restoring force of the secondary resilient member 35. At this time, the engaging surface 342*b* of the secondary limiting member 34 is spaced from the projection 323 of the primary limiting member 32, and thereby the movement of the secondary limiting member 34 in the removing direction Y can be started with the small pressure of the hydraulic oil without urging the primary limiting member 32 against the force of the primary resilient member 33 (see a in FIG. 16).

Furthermore, when the secondary limiting member 34 is moved in the removing direction Y, the stopper surface 340*a* of the secondary limiting member 34, which is spaced from the step surface 304 as shown in FIG. 13B, is exposed to the working chamber 31 to receive the pressure of the hydraulic oil in the working chamber 31. In this way, a large drive force (larger drive force) is exerted on the secondary limiting member 34 in the removing direction Y, so that the secondary limiting member 34 begins to move at a high speed against the restoring force of the secondary resilient member 35 (see a in FIG. 16)

Thereafter, as shown in FIG. 13C, when the engaging surface 342*b* is engaged with the projection 323 to establish the surface-to-surface contact therebetween, the relative slide gap Gr is fluid-tightly sealed relative to the atmospheric chamber 37.

With this sealing function, although the radial size of the relative slide gap Gr, which is adjacent to the working chamber 31, is larger than that of the other slide gaps Gs, Gm1, Gm2, the hydraulic oil does not easily flow from the working chamber 31 to the atmospheric chamber 37 through the relative slide gap Gr. Furthermore, besides the relative slide gap Gr, there exist the slide gaps Gs, Gm1, which are adjacent to the working chamber 31. However, the radial sizes of these slide gaps Gs, Gm1 are made relatively small. Therefore, the hydraulic oil from the working chamber 31 does not easily flow even through the slide gaps Gs, Gm1. In this way, the pressure of the hydraulic oil, which is applied to the secondary limiting member 34 that is engaged with the primary limiting member 32, is effectively increased at the working chamber 31. Therefore, the primary and secondary limiting members 32, 34 can be moved together at the high speed against the restoring forces of the primary and secondary resilient members 33, 35 (see γ in FIG. 16).

As a result, as shown in FIG. 6, the primary limiting member 32, which is urged by the secondary limiting member 34, is quickly moved out of the recesses 152, 151. Thereby, the limiting of the change in the rotational phase can be terminated within a short period of time upon the ending of the engine start period to enable the free adjustment of the valve timing at the early stage. Therefore, in the state where the spool 70 of the control valve 60 is moved into the retarding range Rr of FIG. 7 upon the controlling of the electric power supply to the drive source 82 by the control circuit 84, the hydraulic oil is supplied into the retarding chambers 26-28, and the hydraulic oil of the advancing chambers 22-24 is drained. in this way, the valve timing is retarded. Furthermore, in the state where the spool 70 is moved into the advancing range Ra of FIG. 5 upon the controlling of the electric power supply to the drive source 82 by the control circuit 84, the hydraulic oil is supplied into the advancing chambers 22-24, and the hydraulic oil of the retarding chambers 26-28 is drained. In this way, the valve timing is advanced. In addition, in the state where the spool 70 is moved into the holding range Rh of FIG. 6 upon the controlling of the electric power supply to the drive source 82, the hydraulic oil is kept in the advancing chambers 22-24 and the retarding chambers 26-28.

Here, with respect to the primary limiting member 32, which is removed from the recesses 152, 151 by the pressure of the hydraulic oil in the working chamber 31, the pressure of the hydraulic oil, which is applied to the primary limiting member 32 in the inserting direction X, and the pressure of the hydraulic oil, which is applied to the primary limiting member 32 in the removing direction Y, are canceled with each other. Because of this canceling function, the unintentional entry of the primary limiting member 32 into the recesses 152, 151 can be avoided by stably holding the primary limiting member 32 in the removed position, at which the primary limiting member 32 is removed from the recesses 152, 151 regardless of a change in the pressure of the hydraulic oil caused by the rotation of the engine during the period of adjusting the valve timing.

Furthermore, in the blocking position of the secondary limiting member 34 shown in FIGS. 5 to 7, which is the end of the movable range of the secondary limiting member 34 in the removing direction Y, the secondary limiting member 34 covers the opening of the advancing communication passage 39*a* and the opening of the retarding communication passage 39*b*, so that the advancing communication passage 39*a* and the retarding communication passage 39*b* are disconnected from the atmospheric chamber 37. As discussed above, the advancing communication passage 39*a* and the retarding communication passage 39*b* open to the inner peripheral part (inner peripheral wall surface) of the third fitting hole section 303, and the secondary limiting member 34 is slidably received in the third fitting hole section 303. Furthermore, the relatively small secondary slide gap Gs is formed between the inner peripheral part (inner peripheral wall surface) of the third fitting hole section 303 and the secondary limiting member 34. Therefore, the advancing communication passage 39*a* and the retarding communication passage 39*b* can be reliably disconnected from the atmospheric chamber 37. With the above disconnecting function, at the time of adjusting the valve timing through the supplying of the hydraulic oil to the advancing chambers 22-24 or the retarding chambers 26-28, it is possible to avoid the leakage of the hydraulic oil from each of the advancing chambers 22-24 or the retarding chambers 26-28 to the atmosphere through the atmospheric chamber 37, and it is also possible to avoid the drawing of the air from the atmospheric chamber 37 into each of the advancing chambers 22-24 or the retarding chambers 26-28. Therefore, it is possible to improve the response with respect to the adjustment of the valve timing.

Next, a fail-safe operation at the time of occurrence of the abnormal engine stop will be described.

(i) When the engine is instantaneously stopped due to, for example, an abnormality in engagement of the clutch, the electric power supply from the control circuit 84 to the drive source 82 is stopped, and the spool 70 of the control valve 60 is moved into the lock range RI of FIG. 4. At this time, the pressure of the hydraulic oil, which is supplied from the pump 4 to the advancing chambers 22-24 through the passages 50, 41, 42, 43, 44, is rapidly decreased, so that the force, which is applied to the vane rotor 14 by this pressure of the hydraulic oil, is lost. Thus, the rotational phase is maintained at the rotational phase, which is held at the time of abnormally stopping the engine (the time of instantaneously stopping the engine). Furthermore, at this time, the hydraulic oil of the working chamber 31 is drained into the oil pan 6 thorough the passages 49, 54. Therefore, the drive force, which drives the secondary limiting member 34 in the removing direction Y, is lost. As a result, the secondary limiting member 34, which receives the restoring force of the secondary resilient member 35, is moved in the inserting direction X and thereby pushes the remaining hydraulic oil, which remains in the working chamber 31, toward the lock passage 49. Then, the stopper surface 340*a* of the secondary limiting member 34 contacts the step surface 304 of the receiving hole 30 (see FIGS. 10, 11 and 14). Furthermore, in addition to this movement of the secondary limiting member 34, the primary limiting member 32 receives the restoring force of the primary resilient member 33, so that the projection 323 of the primary limiting member 32 contacts the engaging surface 342*b*, and the primary limiting member 32 is kept moved in the inserting direction X. Thus, as discussed later, the primary limiting member 32 is held at the corresponding position that corresponds to the rotational phase, which is held at the time of abnormally stopping the engine.

(i-1) In the case where the rotational phase, which is held at the time of abnormally stopping the engine, is out of the limited phase range, i.e., when the rotational phase, which is held at the time of abnormally stopping the engine, is on the retarding side of the limited phase range (e.g., the rotational phase, which is held at the time of abnormally stopping the engine, is the most retarded rotational phase), the end surface 320*a* of the primary limiting member 32 cannot be entirely opposed to the recesses 151, 152. Therefore, the primary limiting member 32, which receives the restoring force of the primary resilient member 33, directly engages the inner surface 154 of the front plate 15, and thereby the movement of the primary limiting member 32 in the inserting direction X is limited, as shown in FIG. 14. At this time, the secondary limiting member 34, which engages the step surface 304, is placed in the state where the engaging surface 342*b* of the secondary limiting member 34 is spaced from the projection 323 of the primary limiting member 32 in the inserting direction X. In the above state, the rotational phase is not limited to the lock phase and is left there until the next engine start.

(i-2) In the case where the rotational phase, which is held at the time of abnormally stopping the engine, is on the retarding side of the lock phase within the limited phase range, the end surface 320*a* of the primary limiting member 32 is entirely opposed to the limiting recess 151. Thus, the primary limiting member 32, which receives the restoring force of the primary resilient member 33, moves into the limiting recess 151, as shown in FIG. 11, so that the primary limiting member 32 is placed in the position at which the primary limiting member 32 contacts the bottom part of the recess 151. In the above state, the rotational phase is not limited to the lock phase and is left there until the next engine start.

(i-3) In the case where the rotational phase, which is held at the time of abnormally stopping the engine, is the lock phase, the primary limiting member 32 moves into the limiting recess 151 and the lock recess 152 in the inserting direction X, as discussed above in the above section (I-2), so that the rotational phase is limited to the lock phase.

(i-4) In the case where the rotational phase, which is held at the time of abnormally stopping the engine, is on the advancing side of the lock phase, the end surface 320*a* of the primary limiting member 32 cannot be entirely opposed to the recesses 151, 152. Therefore, as shown in FIG. 14, each of the limiting members 32, 34 is placed in the engaged state discussed above in the section (i-1). Thus, the rotational phase is not limited to the lock phase, and the next start of the engine is waited.

(ii) In the start period of the engine, which is started in response to the engine start command after the abnormal stop of the engine, the control circuit 84 controls the energization of the drive source 82 to move the spool 70 of the control valve 60 to the lock range RI shown in FIG. 4. Then, as discussed above in the section (II), the hydraulic oil, which is supplied from the pump 4, is guided into the advancing chambers 22-24 but is not guided to the working chamber 31. Therefore, the drive force, which drives the secondary limiting member 34 in the removing direction Y, is lost. Therefore, in the engine start period, the rotational phase is adjusted in a manner described below according to the rotational phase, which is held at the time of receiving the engine start command and is substantially the same as the rotational phase, which is held at the time of abnormally stopping the engine.

(ii-1) In the case where the rotational phase, which is held at the time of receiving the engine start command, is on the retarding side of the limited phase range, the vane rotor 14 is rotated relative to the housing 11 toward the advancing side by the negative torque component of the oscillating torque, which is generated by the cranking of the engine, and the restoring force of the assist spring 93. Therefore, the rotational phase is progressively changed toward the advancing side. Thus, as discussed above in the section (I-1), the primary limiting member 32 moves into the limiting recess 151 in the inserting direction X, as shown in FIG. 11 to limit the change in the rotational phase toward the retarding side beyond the limited phase. Thereafter, as shown in FIG. 10, the primary limiting member 32 moves into the lock recess 152 to limit the rotational phase to the lock phase.

Here, at the time immediately before the movement of the primary limiting member 32 into the recesses 151, 152, the secondary limiting member 34 urges the hydraulic oil of the working chamber 31 into the lock passage 49, so that the stopper surface 340*a* of the secondary limiting member 34 contacts the step surface 304, and the engaging surface 342*b* of the secondary limiting member 34 is spaced away from the projection 323 of the primary limiting member 32 in the inserting direction X. Therefore, the secondary limiting member 34, which receives the restoring force of the secondary resilient member 35, can be rapidly moved in the inserting direction X and can be received in the recesses 151, 152 without receiving the substantial resistance, which would be otherwise caused by the hydraulic oil in the working chamber 31, even under the low temperature environment.

Furthermore, as shown in FIG. 15, the limiting members 32, 34, each of which has the relatively small slide gap Gm1, Gm2, Gs relative to the corresponding hole section 300, 301, 303 in the receiving hole 30, can be appropriately held coaxially with the receiving hole 30. Thereby, because of this holding action, it is possible to limit an insertion failure of the primary limiting member 32 into the recesses 151, 152 caused by, for instance, the tilting of the primary limiting member 32 or interference with the secondary limiting member 34 that is tilted relative to the axial direction.

Furthermore, since the slide gap Gr between the primary member 32 and the secondary limiting member 34 is relatively large, it is possible to limit the interference of the primary limiting member 32 with the secondary limiting member 34. Furthermore, the hydraulic oil, which flows into the slide gap Gr that is adjacent to the relatively large working chamber 31, becomes small due to the reduced shearing resistance, which is reduced due to the increase in the slide gap Gr. Furthermore, since the primary limiting member 32 is appropriately held in the hole sections 300, 301, which are located at the opposite axial sides, respectively, in the moving direction of the primary limiting member 32, the relatively large slide gap Gr can be provided in a stable manner between the primary limiting member 32 and the secondary limiting member 34. Thereby, it is possible to limit the decrease in the inserting speed (moving speed) of the primary limiting member 32 in the inserting direction X caused by, for example, the interference or the shearing resistance. Thus, the primary limiting member 32 can be reliably moved into the recesses 151, 152 during the engine start period.

Furthermore, as shown in FIG. 14, in the state where the stopper surface 340*a* of the secondary limiting member 34 contacts the step surface 340*a*, the secondary limiting member 34 is displaced from the blocking position in the inserting direction X. Therefore, the communication passages 39*a*, 39*b* are communicated with the atmospheric chamber 37. Thus, even when the hydraulic oil remains in one of the advancing chamber 22 and the retarding chamber 26, the remaining hydraulic oil can be moved to the other one of the advancing chamber 22 and the retarding chamber 26 through the advancing communication passage 39*a* and the retarding communication passage 39*b*, which are communicated with the common atmospheric chamber 37 and are also communicated with the advancing chamber 22 and the retarding chamber 39, respectively. in this way, it is possible to limit a reduction in the change speed of the rotational phase caused by the remaining hydraulic oil in the advancing chamber 22 or the retarding chamber 26 at the time of moving the primary limiting member 32 from the removed state (the primary limiting member 32 being placed at the outside of the recesses 151, 152) to the inserted state (the primary limiting member 32 being received in the recesses 151, 152) by progressively changing the rotational phase to the lock phase.

In addition, even in the difficult state where the movement of the hydraulic oil is difficult due to the high viscosity of the hydraulic oil at the time of starting the engine (e.g., the degraded state of the hydraulic oil or the low temperature state of the hydraulic oil), the air can be guided from the atmospheric chamber 37, which is opened to the atmosphere, to the advancing chamber 22 and the retarding chamber 26, which are communicated with the advancing communication passage 39*a* and the retarding communication passage 39*b*, respectively. Therefore, it is possible to limit the reduction in the change speed of the rotational phase caused by the generation of the negative pressure in the advancing chamber 22 or the retarding chamber 26, the volume of which is increased by the oscillating torque, at the time of moving the primary limiting member 32 from the removed state (the primary limiting member 32 being placed at the outside of the recesses 151, 152) to the inserted state (the primary limiting member 32 being received in the recesses 151, 152) by progressively changing the rotational phase to the lock phase.

Thereby, even when the rotational phase, which is held at the time of receiving the engine start command, is out of the limited phase range due to the abnormal engine stop, it is possible to return the rotational phase to the lock phase, which is most suitable for the engine start, within the short period of time. Also, at the lock phase, the primary limiting member 32 can be quickly moved into the lock recess 152. Therefore, the engine startability can be reliably ensured.

(ii-2) in the case where the rotational phase, which is held at the time of receiving the engine start command, is on the retarding side of the lock phase in the limited phase range, the operation, which is similar to the one discussed in the above section (ii-1), is started at the rotational phase, which is held at the time of receiving the engine start command. Therefore, even in such a case, the rotational phase can be quickly returned to the lock phase. Also, at the lock phase, the primary limiting member 32 can be quickly moved into the lock recess 152, so that the required engine startability can be reliably ensured.

(ii-3) in the case where the rotational phase is the lock phase, the operation, which is similar to the one discussed in the above section (II), is executed, so that the required engine startability can be reliably ensured.

(ii-4) In the case where the rotational phase, which is held at the time of receiving the engine start command, is on the advancing side of the lock phase, the hydraulic oil is guided into the advancing chambers 22-24 in the state shown in FIG. 4, so that the rotational phase is adjusted to the most advanced phase. Thus, in such a case, the engine start is executed at the most advanced phase, which serves as the limited phase, and thereby the required engine startability can be ensured.

(iii) When the engine start period after the abnormal engine stop, is terminated, the operation, which is similar to the one discussed in the above section (III), is executed. Therefore, the primary limiting member 32 is urged by the secondary limiting member 34 in the removing direction Y, so that the primary limiting member 32 is quickly moved out of the recesses 152, 151 in the removing direction Y. Thereby, the free valve timing adjustment is made possible.

As discussed above, the valve timing control apparatus 1 of the present embodiment ensures the required engine startability regardless of the surrounding environmental temperature. Furthermore, after the completion of the engine start, the valve timing can be freely adjusted.

The present invention has been described with respect to the one embodiment of the present invention. However, the present invention is not limited to the above embodiment, and the above embodiment may be modified in various ways within a spirit and scope of the present invention.

Specifically, instead of providing both of the limiting recess 151 and the lock recess 152, it is possible to provide only the lock recess 152. Furthermore, similar to the valve timing control apparatus recited in Japanese Patent Application No. 2009-193566 (corresponding to WO/2010/029740A1), one or more other set(s) of the primary limiting member, the secondary limiting member, the primary resilient member, the secondary limiting member, the limiting recess and the lock recess may be provided besides the primary limiting member 32, the secondary limiting member 34, the primary resilient member 33, the secondary resilient member 35, the limiting recess 151 and the lock recess 152 discussed in the above embodiment. Furthermore, similar to the valve timing control apparatus recited in Japanese Patent Application No. 2009-193566 (corresponding to WO/2010/029740A1), it is possible to provide a set of a single limiting member and a recess in addition to the primary limiting member 32, the secondary limiting member 34, the primary resilient member 33, the secondary resilient member 35, the limiting recess 151 and the lock recess 152 discussed in the above embodiment.

The engaging surface 342*b* of the secondary limiting member 34 may be configured to contact the projection 323 of the primary limiting member 32 in the state where the primary limiting member 32 is received in the recesses 151, 152, and the stopper surface 340*a* of the secondary limiting member 34 contacts the step surface 304 of the receiving hole 30. Furthermore, the outer diameter of the first slidable portion 320 and the outer diameter of the second slidable portion 321 may be set to be different from each other.

The receiving hole 30, which receives the primary limiting member 32, the secondary limiting member 34, the primary resilient member 33 and the secondary resilient member 35, may be formed in the rotatable shaft 140 of the vane rotor 14 as long as the receiving hole 30 is eccentric to the central axis O. Furthermore, the second fitting hole section 301 may be eliminated from the receiving hole 30 such that the primary limiting member 32 is slidably receivable only in the first fitting hole section 300. Furthermore, the atmospheric chamber 37 of the receiving hole 30 may be configured to be not open to the atmosphere. Also, the back pressure chamber 38 may be configured to be open to the atmosphere. Furthermore, at least one of the advancing communication passage 39*a* and the retarding communication passage 39*b*, which open to the inner peripheral wall surface (inner peripheral part) of the receiving hole 30, may be eliminated.

Furthermore, in the above embodiment, the control valve 60 is received in the vane rotor 14. Alternatively, the control valve 60 may be received in the camshaft 2. Further alternatively, the control valve 60 may be placed on the upstream side of the camshaft 2 in the hydraulic oil passage, which extends from the pump 4 to the drive device 10 through the camshaft 2. Furthermore, similar to the valve timing control apparatus recited in Japanese Patent Application No. 2009-193566 (corresponding to WO/2010/029740A1), the lock port 663 and the secondary supply port 665 may be eliminated from the control valve 60, and there may be provided another control valve that is configured to switch between a communicating state, in which the lock passage 49 and the secondary supply passage 52 are communicated with each other through the another control valve, and a blocking state, in which the communication between the lock passage 49 and the secondary supply passage 52 is blocked by the another control valve.

Furthermore, at least one of the check valve 500 and the check valve 520 may be eliminated. Furthermore, the relationship between the advancing and the retarding may be reversed from the one discussed in the above embodiment. Furthermore, the present invention is also applicable to any other type of valve timing control apparatus, which controls valve timing of exhaust valves (drive-subject valves) or which controls both of the valve timing of the intake valves (drive-subject valves) and the valve timing of the exhaust valves (drive-subject valves).

Additional advantages and modifications will readily occur to those skilled in the art. The invention in its broader terms is therefore not limited to the specific details, representative apparatus, and illustrative examples shown and described.

What is claimed is:

1. A vane timing control apparatus for an internal combustion engine, wherein the valve timing control apparatus is supplied with hydraulic fluid from a supply source upon rotation of the internal combustion engine to control valve timing of a valve, which is opened or closed by a camshaft that is, in turn, driven by a torque transmitted from a crankshaft of the internal combustion engine, the valve timing control apparatus comprising:

a housing that includes a recess, which is recessed in an inner surface of the housing, wherein the housing is adapted to be rotated synchronously with the crankshaft;

a vane rotor that includes:

a vane, which partitions between an advancing chamber and a retarding chamber in an inside of the housing; and a receiving hole, which forms a working chamber therein, wherein:

the vane rotor is adapted to be rotated together with the camshaft; and the vane rotor changes a rotational phase of the vane rotor relative to the housing toward a corresponding one of an advancing side and a retarding side when the hydraulic fluid is supplied into a corresponding one of the advancing chamber and the retarding chamber;

a primary limiting member that is reciprocatably received in the receiving hole, wherein:

the primary limiting member limits the rotational phase to a limited phase, which is between a most advanced phase and a most retarded phase, when the primary limiting member is inserted into the recess in an inserting direction; and the primary limiting member releases the rotational phase from the limited phase when the primary limiting member is removed from the recess in a removing direction;

a primary resilient member that urges the primary limiting member in the inserting direction, wherein:

the primary resilient member urges the primary limiting member into the recess in the inserting direction in a state where the rotational phase is the limited phase; and the primary resilient member urges the primary limiting member against the inner surface of the housing when the primary resilient member urges the primary limiting member in the inserting direction in a state where the rotational phase is other than the limited phase;

a secondary limiting member that is reciprocatably received in the receiving hole, wherein:

the secondary limiting member is configured into a tubular body, into which the primary limiting member is slidably received in a manner that enables relative slide movement between the primary limiting member and the secondary limiting member;

the secondary limiting member includes an engaging surface, which is disengageable from the primary limiting member in the inserting direction and is engageable with the primary limiting member in the removing direction; and the secondary limiting member receives a pressure of the hydraulic fluid, which is provided in the working chamber, in the removing direction; and a secondary resilient member that urges the secondary limiting member in the inserting direction, wherein:

a relative slide gap is formed between the primary limiting member and the secondary limiting member at a location adjacent to the working chamber;

a primary slide gap is formed between the primary limiting member and the receiving hole;

the relative slide gap is larger than the primary slide gap;

a secondary slide gap is formed between the secondary limiting member and the receiving hole; and the relative slide Rap at a narrowest distance between the secondary limiting member and the primary limiting member is larger than the secondary slide gap at a broadest distance between the secondary limiting member and the receiving hole.

2. The valve timing control apparatus according to claim 1, wherein:

the working chamber is formed on one side of the secondary limiting member in the inserting direction in the receiving hole;

an atmospheric chamber, which opens to atmosphere, is formed on the other side of the secondary limiting member, which is opposite from the one side of the secondary limiting member in the removing direction in the receiving hole; and the secondary slide gap is adjacent to both of the working chamber and the atmospheric chamber.

3. The valve timing control apparatus according to claim 2, wherein:

the primary limiting member includes a projection, which radially outwardly projects in the atmospheric chamber; and the engaging surface of the secondary limiting member is engaged with the projection of the primary limiting member to seal the relative slide gap relative to the atmospheric chamber when the secondary limiting member is moved in the removing direction.

4. The valve timing control apparatus according to claim 3, wherein:

the secondary limiting member further includes:

a stopper surface, which is an end surface of the secondary limiting member in the inserting direction, wherein movement of the stopper surface of the secondary limiting member in the inserting direction is limited when the stopper surface of the secondary limiting member is moved in the inserting direction from an exposed state, in which the stopper surface of the secondary limiting member is exposed in the working chamber, to an engaged state, in which the stopper surface of the secondary limiting member is engaged with the receiving hole; and a pressure receiving surface, which is exposed in the working chamber and thereby receives the pressure of the hydraulic fluid of the working chamber in the removing direction; and the engaging surface of the secondary limiting member seals the relative slide gap relative to the atmospheric chamber when the secondary limiting member is moved in the removing direction from a disengaged state, in which the engaging surface of the secondary limiting member is disengaged from the projection in the inserting direction by inserting the primary limiting member into the recess and by engaging the stopper surface of the secondary limiting member with the receiving hole, to an engaged state, in which the engaging surface of the secondary limiting member is engaged with the projection.

5. The valve timing control apparatus according to claim 2, wherein:

the vane rotor further includes:

an advancing communication passage, which is communicated with the advancing chamber; and a retarding communication passage, which is communicated with the retarding chamber;

the receiving hole has an inner peripheral portion, to which the advancing communication passage and the retarding communication passage open, and the inner peripheral portion of the receiving hole has a fitting hole section, which forms the secondary slide gap between the fitting hole section and the secondary limiting member upon slidable fitting of the secondary limiting member into the fitting hole section when the secondary limiting member is moved in the inserting direction, the secondary limiting member enables communication of the advancing communication passage and the retarding communication passage to the atmospheric chamber; and when the secondary limiting member is moved in the removing direction, the secondary limiting member blocks the communication of the advancing communication passage and the retarding communication passage to the atmospheric chamber.

6. The valve timing control apparatus according to claim 1, wherein:

the receiving hole includes a first fitting hole section and a second fitting hole section, which form the primary slide gap relative to the primary limiting member upon reciprocatably and slidably fitting of the primary limiting member into the first fitting hole section and the second fitting hole section; and the first fitting hole section and the second fitting hole section are respectively formed in one end part of the receiving hole in the inserting direction and the other end part of the receiving hole in the removing direction.

7. The valve timing control apparatus according to claim 6, wherein:

the first fitting hole section of the receiving hole is communicatable with the recess, into which the hydraulic fluid is supplied;

the second fitting hole section of the receiving hole forms a back pressure chamber between the second fitting hole section and the primary limiting member;

the primary limiting member includes:

a first slidable portion that is fitted in the first fitting hole section and has a first end surface of the primary limiting member, which is located at an end of the primary limiting member in the inserting direction and is opposable to the recess;

a second slidable portion that is fitted in the second fitting hole section and has a second end surface of the primary limiting member, which is located at the other end of the primary limiting member in the removing direction and is exposed in the back pressure chamber; and a through-hole, which penetrates through the primary limiting member between the first end surface and the second end surface of the primary limiting member; and a pressure, which is applied from the hydraulic fluid to the primary limiting member in the inserting direction, and a pressure, which is applied from the hydraulic fluid to the primary limiting member in the removing direction, are canceled with each other.

8. The valve timing control apparatus according to claim 6, wherein:

the receiving hole includes:

a third fitting hole section, which is formed between the first fitting hole section and the second fitting hole section; and an annular groove section, which is located radially outward of the second fitting hole section and circumferentially surrounds the second fitting hole section;

the secondary limiting member includes:

a radially inner slidable portion, which is configured into a tubular form and is slidably fitted to the primary limiting member to form the relative slide gap relative to the primary limiting member; and a radially outer slidable portion, which is configured into a tubular form and is reciprocatably and slidably fitted to the third fitting hole section to form the secondary slide gap;

the radially outer slidable portion has an outer diameter, which is larger than that of the radially inner slidable portion, wherein the radially outer slidable portion is located on a side of the radially inner slidable portion in the removing direction; and the radially outer slidable portion is inserted into the annular groove section when the radially outer slidable portion is moved in the removing direction.

* * * * *